United States Patent [19]

Lowndes, III et al.

[11] Patent Number: 5,035,592

[45] Date of Patent: Jul. 30, 1991

[54] APPARATUS FOR CONCRETE SUPPLY AND FORM VIBRATION

[75] Inventors: William Lowndes, III; Francis V. Gay, III; Benjamin A. Gay, all of Spartanburg, S.C.

[73] Assignee: Lowndes Corporation, Spartanburg, S.C.

[21] Appl. No.: 405,679

[22] Filed: Sep. 11, 1989

Related U.S. Application Data

[62] Division of Ser. No. 131,653, Dec. 11, 1987, Pat. No. 4,884,958.

[51] Int. Cl.[5] ..... B28B 13/02; B28B 1/08

[52] U.S. Cl. ..... 425/64; 425/3; 425/219; 425/432

[58] Field of Search ..... 425/62-64, 425/111, 117, 219, 432, 456, 3; 264/70, 71

[56] References Cited

U.S. PATENT DOCUMENTS

| | | | |
|---|---|---|---|
| 3,217,375 | 11/1965 | Kinnard | 425/219 |
| 3,382,304 | 5/1968 | Nagy | 425/219 |
| 3,566,490 | 3/1971 | Nagy | 425/219 |
| 3,583,046 | 6/1971 | Dickinson et al. | 425/111 |
| 3,601,870 | 8/1971 | Jones | 425/111 |
| 3,647,308 | 3/1972 | Yost | 425/219 |
| 3,948,354 | 4/1976 | Fosse et al. | 425/456 |
| 4,266,917 | 5/1981 | Godberson | 425/64 |

"Automated Placing Machine" brochure by Martin Industries, Concrete Engineering Division, Fort Worth, Texas (1977)

Three brochures concerning "BedMate", Tarp Roller and "Vibrotrock" Vibration System by Hamilton Equipment Company, Inc., Fort Worth, Texas

*Primary Examiner*—James C. Housel

*Attorney, Agent, or Firm*—Dority & Manning

[57] ABSTRACT

A method and an apparatus for setting up a concrete form for the subsequent forming of a concrete member therein and for continuously supplying a concrete form with concrete. The apparatus for setting up the concrete form includes a deck brush for cleaning the deck portions of an elongated concrete form, stem brushes for cleaning the stem portions of the concrete form, nozzles for spraying pressurized lubrication fluid onto the form, strand pulling and placing devices for placing reinforcing strands in the stem portions of the concrete form, rams for depressing the strands down into the stem portions after tensioning thereof, and a deck reinforcing material dispensing system which simultaneously straightens and dispenses deck wire onto the deck portion of the concrete form. The pouring machine includes hoppers for supplying concrete through vibratory feeders, a first concrete spreader for spreading concrete in the form supplied by the hoppers, a concrete compactor for compacting the concrete spread by the concrete spreaders, and a second concrete spreader for providing a final surface finish to the concrete members being formed in the concrete form. Concrete form vibrators are provided on the pouring machine for continuously vibrating the concrete form through contact therewith as the pouring machine moves along the concrete form pouring concrete.

20 Claims, 14 Drawing Sheets

APPARATUS FOR CONCRETE SUPPLY AND FORM VIBRATION

This is a division of application Ser. No. 131,653, filed Dec. 11, 1987, now U.S. Pat. No. 4,884,958.

BACKGROUND OF THE INVENTION

This invention relates to a method and an apparatus for setting up a concrete form for the forming of a concrete member therein. This invention also relates to a method and apparatus for continuously supplying the concrete form with concrete.

Precast and prestressed concrete structural members are typically formed by pouring concrete into a form which molds the concrete into a desired shape for the structural member. Conventional shapes for the structural members include those having a rectangular, single "T" or double "T" shaped cross-section. These concrete members are thus accordingly known in the industry as flat slabs or panels and "single-tee" and "double-tee" beams. A single-tee beam includes a horizontal deck portion having a leg or stem portion which extends vertically downwardly from a central area of the deck portion. A double-tee beam is similar to the single-tee beam except that it includes two legs or stem portions extending vertically downward from the deck portion.

A common application of such beams is in the formation of roofing and flooring sections of parking garages for cars, and for other portions of buildings in which the application of the beams would be appropriate. The beams are placed side-by-side, and may be attached to one another through the welding together of steel weld assemblies, which include bars embedded in the deck portion of the beam and which are provided on the edges of the deck portions of the beams. Alternately, weld plates such as those disclosed in co-pending U.S. patent application Ser. No. 06/887,519, filed July 21, 1986, entitled, "Side Weld Plate", could be provided on the sides of the deck portions for welding to one another, which would allow the deck portions to be maintained in a secure, side-by-side relationship.

Although the present invention could be used in connection with the forming of a variety of shapes of concrete members, it is discussed for illustrative purposes as being used primarily in the forming of double-tee beams. A conventional double-tee beam form for forming elongated concrete double-tee beams is normally constructed of steel and includes horizontal surfaces for forming the deck portions of the beam and downwardly and inwardly sloped surfaces depending from the horizontal surfaces of the form for forming the leg or stem sections of the double-tee beam. The stem portion of the double-tee beam formed must slope generally downwardly and inwardly to permit the molded double-tee beam to be readily removed from the form upon hardening.

Prior to the pouring of the concrete into the form, tensioned wire cable strands are provided the lengths of the stem forming portions of the concrete form. These tensioned strands are typically depressed and held down to the bottom surface of the stem forming portion of the concrete form and become embedded in the double-tee beam for strengthening it. Sheets of reinforcing material such as wire mesh or wire fabric are also provided in areas of the stem portions and on the horizontal surfaces of the concrete form prior to the pouring of the concrete therein. Upon the pouring of the concrete into the form, the strands, which are tensioned, and the sheets of wire fabric are embedded into the concrete member for prestressing it to add increased strength to the beam once it is removed from the form.

A typical concrete form in which double-tee beams are poured may be up to several hundred feet long. Because the required length of the beams to be poured are generally much less than the length of the form, the form is used to pour several beams at a time, the form being divided by dividing members commonly referred to as bulkheads. The bulkheads are typically steel and may weigh in the upwards of several hundred pounds. Bulkheads have a cross-sectional shape generally similar to that of the cross-section of the beam which is to be formed and are inserted into the concrete form at appropriate places for dividing the concrete form into several compartments for forming several beams at a time. The bulkheads include slotted members which extend into the stem portions of the concrete form. Provided in the slotted members are strand dividers which serve to support and separate the tensioned strands in the stem portions of the concrete form. Because of their weight, the placement and removal of the bulkheads from the concrete form are commonly performed using a crane, winch mechanism, or the like.

After the pouring of the concrete into the form, a tarpaulin or cover is generally provided to cover the deck portion of the beam during curing, which otherwise would be exposed to the environment. Prior to removing the beams from the form, the cover is removed.

A machine is presently manufactured for use in the setting up of a concrete form in which double-tee beams are to be poured. The machine is the "Utility Kart", manufactured by , Inc. of Menomonee Falls, Wisconsin. The machine is hydraulically powered by a gas powered engine and includes a cover reel for unrolling, rolling up, and storing a concrete form cover as the machine passes over the concrete form. A lift is also provided on the machine for removing and setting bulkheads into the concrete form. The hydraulic system of the machine depresses the strands into the stem portions of the concrete form prior to the pouring of concrete. After pouring of the concrete, hydraulically powered screens are used for settling and removing air pockets from the concrete. After screeding of the concrete, the cover reel is used to replace the cover thereon.

After the concrete beams have been removed from the elongated form, and before the pouring of concrete into the form for the next beams, the form must be cleaned. This can be done manually, or, as disclosed in U.S. Pat. No. 4,578,837, granted to Baer, entitled, "Apparatus for Cleaning Tee Forms", the stem portions of the concrete form can be cleaned with a rotating brush assembly which is powered by an engine. The engine and brush assembly are movable along the concrete form for cleaning the stem portions along the length thereof. U.S. Pat. No. 3,562,832, granted to Rickard, discloses the use of powered horizontal brushes for cleaning the horizontal surfaces of the concrete form and powered conical brushes which are for cleaning the sides of the stem portions of the form as the machine is moved along the form.

After cleaning of the concrete form and prior to the pouring of the concrete, the surfaces of the concrete form are generally provided with a coating of release or form oil which lubricates the surfaces of the form for allowing easier removal of the concrete beam from the form after hardening. The application of the form oil to the concrete form is often applied by the use of hand held sprayers.

After setting up of the concrete form with the bulkheads, tensioned strands, deck wire, stem reinforcing material, weldment fixtures, etc., the concrete form is ready for receiving the concrete. The supplying of concrete to the form is generally done with a series of concrete pourings, with the concrete then being spread and compacted into the form in some manner. The deck portion of the beam is screeded for providing it with a suitable surface finish.

Various devices exist for dispensing concrete from a moving structure. U.S. Pat. No. 806,371, granted to Siegwart, entitled, "Machine for Manufacturing Hollow Artificial Stone Beams or Girders", discloses a device having cement supply hoppers attached to a carriage which is movable by a motor. Another device, manufactured by Hamilton Equipment Company of Fort Worth, Texas, inlcudes a concrete form vibrator for settling concrete in the form which uses inflatable bladders for forcing a pneumatic vibrator on a track against a concrete form. The vibrator is typically moved manually in the track.

Other patented devices for use in forming concrete objects are disclosed in the following U.S. Pat. Nos. having the Ser. Nos. of: 1,540,901; ,2,571,876; 2,853,250; 2,962,949; 3,200,177; 3,397,565; 3,530,552; 3,534,449; 3,604,324; 3,647,308; and 4,522,579.

Of the above devices, however, none is particularly adapted, as is a utility machine of the present invention, for the setting up of a concrete form, wherein the concrete form is cleaned, provided with tensioned strands which are depressed, and lubricated with form oil.

The present invention also includes a pouring machine for moving along the concrete form having means for continuously supplying concrete to the concrete form and means for continuously vibrating the concrete form as the pouring machine moves therealong. The pouring machine further includes a spreader and a compactor for spreading and compacting concrete into the concrete form as the pouring machine passes therealong.

SUMMARY OF THE INVENTION

The present invention recognizes and addresses such drawbacks of prior art. Thus, it is a general object of the present invention to provide an apparatus for facilitating the setting up of a concrete form prior to the pouring of the concrete therein.

Another object of the present invention is to provide a method for setting up the concrete form prior to pouring of concrete.

Another object of the present invention is to provide an apparatus for continuously pouring concrete into a concrete form while both moving along and vibrating the form.

Another object of the present invention is to provide a method for pouring concrete into an elongated form while vibrating the form.

Another object of the present invention is to provide an apparatus having means for simultaneously cleaning the deck surfaces and stem surfaces of an elongated concrete form.

Another object of the present invention is to provide an apparatus having means for lubricating the surfaces of an elongated form as the apparatus moves therealong.

Another object of the present invention is to provide an apparatus for pulling lengths of reinforcing strand outside of an elongated concrete form.

Another object of the present invention is to provide an apparatus having means for placing reinforcement strands in the stem portions of an elongated form as the apparatus moves along.

Another object of the present invention is to provide an apparatus having means for dispensing strand guide brackets therefrom as the apparatus moves along an elongated concrete form.

Another object of the present invention is to provide an apparatus having deck reinforcement material dispensing means for allowing a roll of deck reinforcing material to be unrolled therefrom and straightened as it is placed onto the deck surfaces of an elongated concrete form as the apparatus moves therealong.

Another object of the present invention is to provide an apparatus having means thereon for depressing strands pulled in an elongated concrete form into the stem portions thereof.

Another object of the present invention is to provide a self-propelled apparatus for moving above an elongated concrete form.

Another object of the present invention is to provide an apparatus for moving along the concrete form having a lifting device provided thereon for raising from and lowering objects into an elongated concrete form.

Another object of the present invention is to provide a self-propelled apparatus for continuously pouring concrete into an elongated concrete form as the apparatus moves therealong.

Still another object of the present invention is to provide an apparatus for continuously pouring concrete having a forward concrete spreader and a trailing concrete compactor for spreading and compacting concrete supplied from the apparatus into an elongated concrete form.

Yet another object of the present invention is to provide an apparatus for continuously pouring concrete into an elongated form having means for contacting and vibrating the concrete form as the apparatus moves therealong.

Various combinations of the presently disclosed features may be provided in a given embodiment thereof in accordance with this invention. Generally, one such exemplary embodiment of the present invention includes an apparatus for use in the forming of a concrete member in an elongated concrete form. The apparatus comprises a frame structure positionable above the elongated concrete form and support means provided on the frame structure for supporting the frame structure above the elongated concrete form for movement therealong. Motive means are provided on the frame structure for moving the frame structure along the elongated concrete form on the support means. Means are provided on the frame structure for dispensing a cover for the elongated form. Means are also included on the frame structure for installing and removing a bulkhead from the elongated concrete form. Deck cleaning means for cleaning the deck portion of the elongated concrete form are provided on the frame structure as are stem cleaning means for cleaning a stem portion of the elongated concrete form. Means for lubricating the deck and stem portions of the elongated concrete form are also included on the frame structure.

Means are provided on the frame structure for pulling at least one strand from a strand source for placement in the elongated concrete form, and means are provided on the frame structure for placing the strand in a stem portion of the elongated concrete form. Further means are provided on the frame structure for tensioning at least on strand in the elongated concrete form.

Means are included on the frame structure for placing at least one strand guide in a stem portion of the elongated concrete form for supporting the strand. Means are further included on the frame structure for depressing the strand into a stem portion of the elongated concrete form. Moreover, means are provided on the frame structure for dispensing deck reinforcing material onto the deck surface of the elongated concrete form.

A method is also disclosed in the present invention for setting up and preparing the elongated concrete form for the receipt of concrete for forming another concrete member.

Another aspect of the present invention includes an apparatus for pouring concrete into an elongated form. The apparatus comprises a frame structure positionable above the elongated concrete form. Support means are provided on the frame structure for supporting the frame structure above the elongated concrete form for movement thereon. Motive means are included on the frame structure for moving the frame structure along the elongated concrete form on the support means, and concrete supply means are included on the frame structure for supplying concrete to the elongated concrete form. First concrete spreader means are included on the frame structure for spreading out in the elongated concrete form the concrete supplied thereto, and concrete compaction means are provided on the frame structure for compacting into the elongated concrete form the concrete supplied thereto. Concrete form vibration means are provided on the frame structure and are contactable with the elongated concrete form for vibrating the elongated concrete form and settling the concrete supplied thereto as the frame structure moves along the elongated concrete form. Further, second concrete spreader means are connected to the frame structure for spreading out in the elongated concrete form the concrete supplied thereto after compaction.

Also disclosed by the present invention is a method for pouring concrete into an elongated form, wherein the method includes vibrating the elongated concrete form and settling the concrete supplied thereto as a frame structure moves along an elongated concrete form.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, in which.

DESCRIPTION OF THE PREFERRED EMBODIMENT

Figure 1:
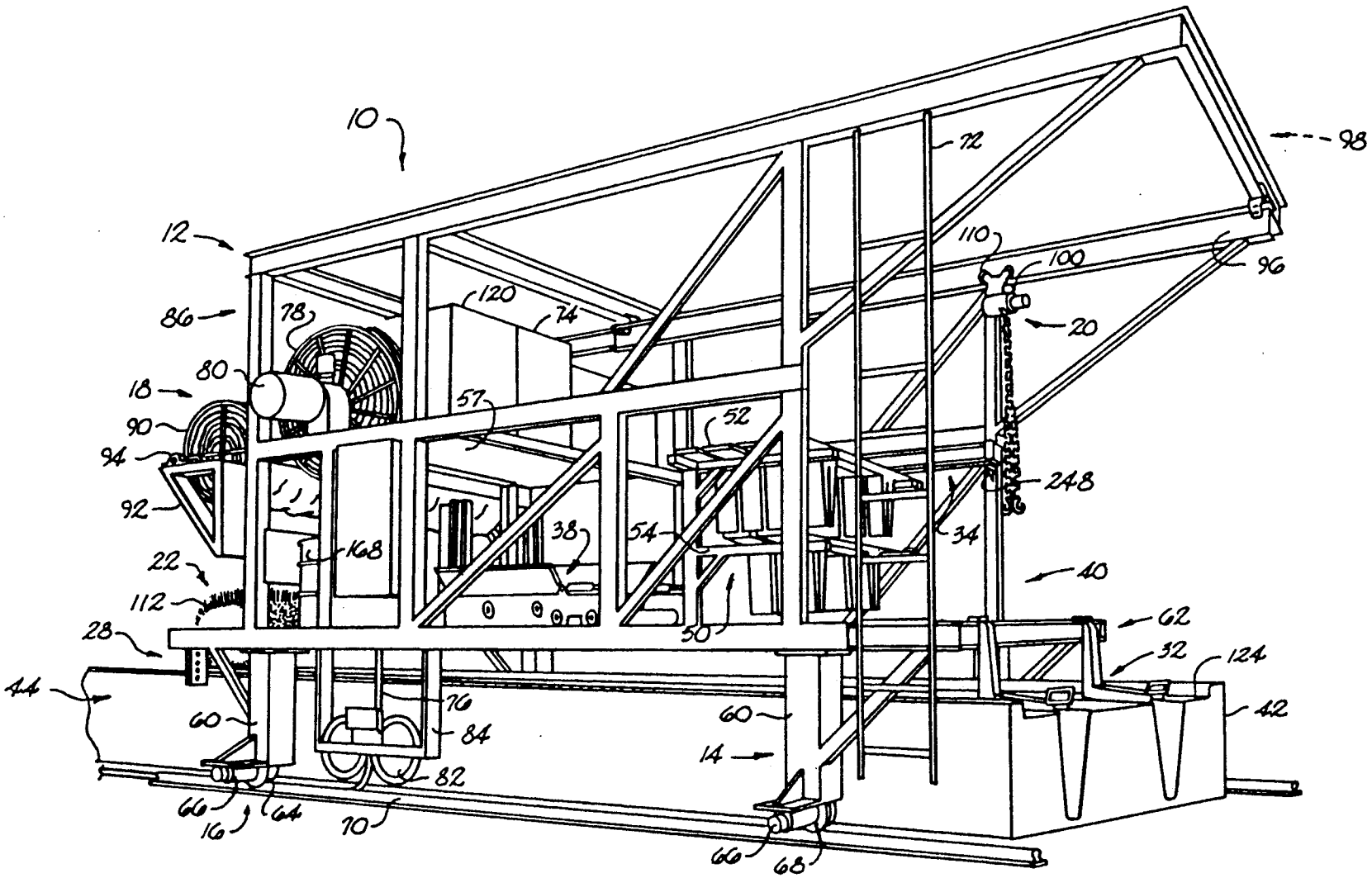
FIG. 1 is a perspective view of a utility machine constructed in accordance with the present invention for setting up an elongated concrete form for receiving concrete.
Figure 2:
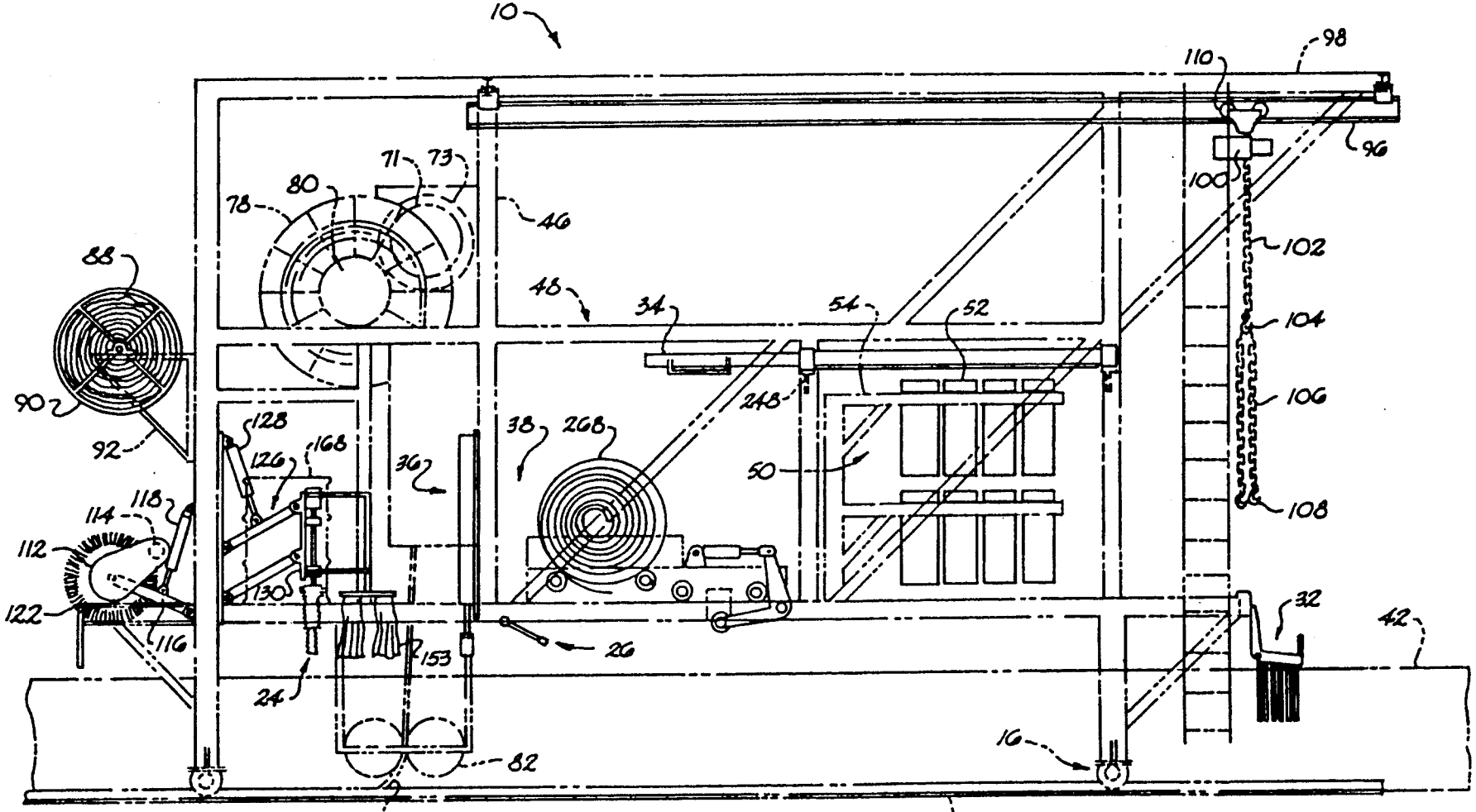
FIG. 2 is a side elevational view of a utility machine constructed in accordance with the present invention.
Figure 8A:
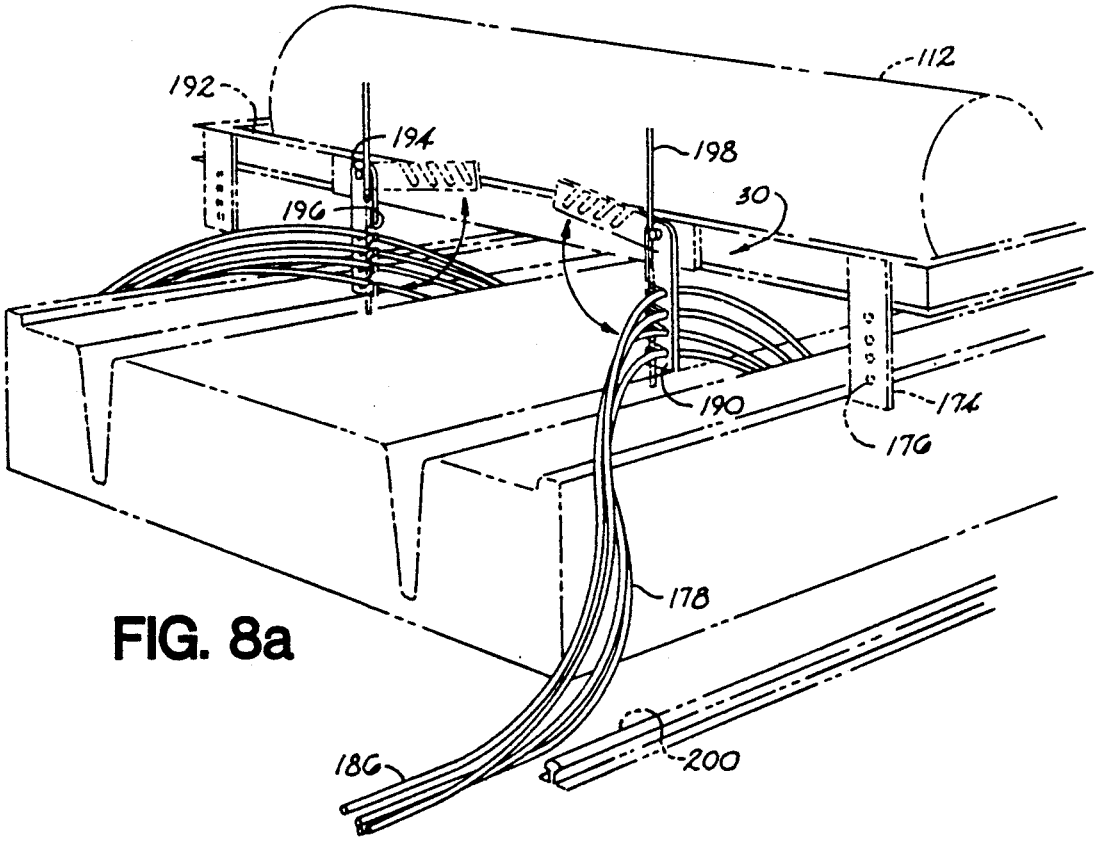
FIG. 8*a* is a partial perspective view of strand placement members provided on the utility machine for placing strand in the stem portions of the concrete forms.

Referring to the drawings in detail, wherein like reference characters represent like elements and/or features throughout the various views, the utility machine of the present invention is designated generally in FIG. 1 by the reference character 10. As illustrated in FIGS. 1, 2, and 8*a*, utility machine 10 includes a frame structure, generally 12, support means, generally 14, motive means, generally 16, reel means, generally 18, crane means, generally 20, deck cleaning means, generally 22, stem cleaning means, generally 24, lubrication means, generally 26, strand pulling means, generally 28, strand placement means, generally 30, strand guide placement means, generally 32, strand tensioning means, generally 34, strand depressing means, generally 36, and deck reinforcing material dispensing means, generally 38.

Frame structure 12 includes an upper portion, generally 40, which is positionable above an elongated concrete form 42, and a lower portion, generally 44, which is positionable generally along the sides of concrete form 42 for allowing frame structure 12 to straddle concrete form 42.

Figure 4:
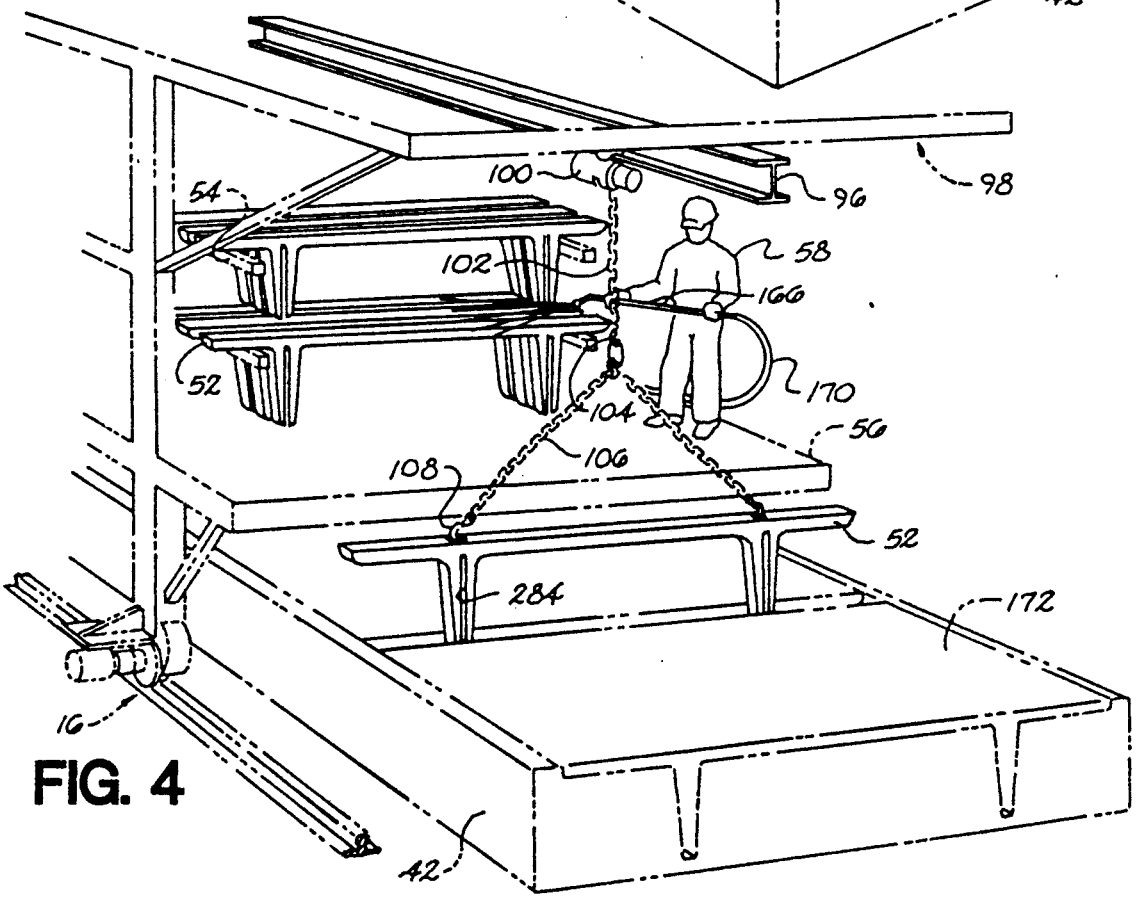
FIG. 4 is a partial perspective view of a crane provided on the utility machine handling a bulkhead.

Upper portion 40 of frame structure 12 includes vertical support members, generally 46, and horizontal support members, generally 48, which are preferably steel and attached to one another by welding. It is to be understood, however, that members 46, 48 could be constructed of any suitable material and could be fastened together with any suitable fastening means. Upper portion 40 has provided thereon racks, generally 50, which are for supporting a plurality of bulkheads 52. Bulkheads 52 act as dividers for dividing up concrete form 42 to allow a plurality of concrete members to be formed therein simultaneously. Racks 50 include substantially horizontally extending bars 54 for supporting bulkheads 52 thereon. Upper portion 40 of frame structure 12 also includes platforms 56, 57 for supporting workers 58, such as illustrated in FIG. 4, thereon.

Lower portion 44 of frame structure 12 includes vertically extending supports 60 which depend downwardly from base portion, generally 62, of frame structure 12. Rotatably mounted on the lower ends of vertically extending supports 60 are wheels 64. Wheels 64 are rotatably connected to hydraulic motors 66, which are also provided on the lower ends of vertically extending supports 60. Wheels 64 are provided with circumferential flanges 68 for guiding wheels 64 on rails 70. Rails 70 extend on either side of concrete form 42 and are for supporting frame structure 12 thereon for movement along concrete form 42. A ladder 72 is attached to frame structure 12 adjacent a vertical support 60 for allowing a worker to climb onto upper portion 40 of frame structure 12.

Hydraulic motors 66 are powered by a conventional hydraulic pump 71 which is powered by a conventional electric motor 73. The hydraulic pump and electric motor work together as a unit and are referred to and indicated generally as power unit 74. Power unit 74 includes a power cable extending therefrom to a power source (not shown). Power cable 76 is provided on a motorized power cord reel 78 which is powered by a conventional electric motor 80. As utility machine 10 moves along concrete form 42, power cord reel 78 is operated to either unwind or wind up power cable 76 thereon such that power cable 76 is kept from being too tight or from becoming entangled. Power cable guides 82 are rotatably mounted to the sub-frame structure 84 which is attached to frame structure 12. Power cable 76 passes between power cable guides 82 as it is being unwound from or rolled up onto power cord reel 78.

Figure 3:
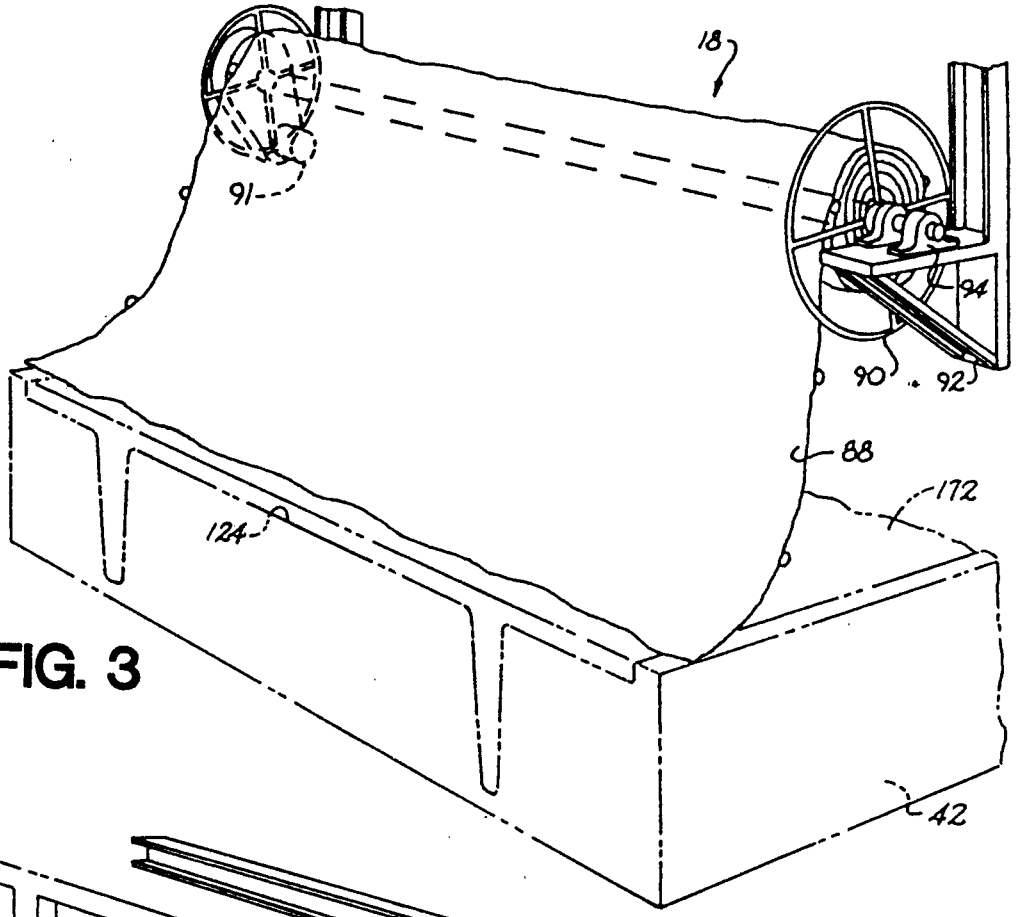
FIG. 3 is a partial perspective view of a reel device connected to the utility machine and provided with a concrete form cover.

Reel means 18 is provided on a forward portion, generally 86, of utility machine 10 and is for rolling up a concrete form cover 88 or unrolling it therefrom, as the case may be. Reel means 18 is also used for storing concrete form cover 88 thereon when it is not in use. As illustrated in FIG. 3, reel means 18 includes a generally spool-shaped reel structure 90 which is rotatably powered by a motor 91. Reel structure 90 is mounted to a sub-frame structure 92 by means of bearing blocks 94. Reel structure 90 is rotatable in two directions, one for unrolling concrete form cover 88 therefrom and one for rolling concrete form cover 88 thereon. It is also to be noted that the rotational speed of reel structure 90 is adjustable to compensate for the decrease in the diameter of cover 88 on reel structure 90 as it is unwound and also to compensate for the increase in the diameter of the cover 88 as it is wound back up, relative to the movement of machine 10 along concrete form 42.

Crane means 20 includes a substantially horizontally extending track 96 which is attached to a top portion, generally 98, of frame structure 12. Crane means 20 includes a conventionally powered winch or hoist 100 which has a cable or chain 102 having a hook 104 for lifting or lowering objects directly or through use of another chain 106 having hooks 108. Hoist 100 includes rollers 110 which engage track 96 to allow hoist 100 to be moved longitudinally therealong. Hoist 100 is used to remove a bulkhead 52 from concrete form 42 and for placing it on a rack 50. Hoist 100 is also used for removing a bulkhead 52 from a rack 50 and for lowering it into position in concrete form 42. Of course, hoist 100 also has many other uses for lifting and lowering objects from frame structure 12.

Figure 5:
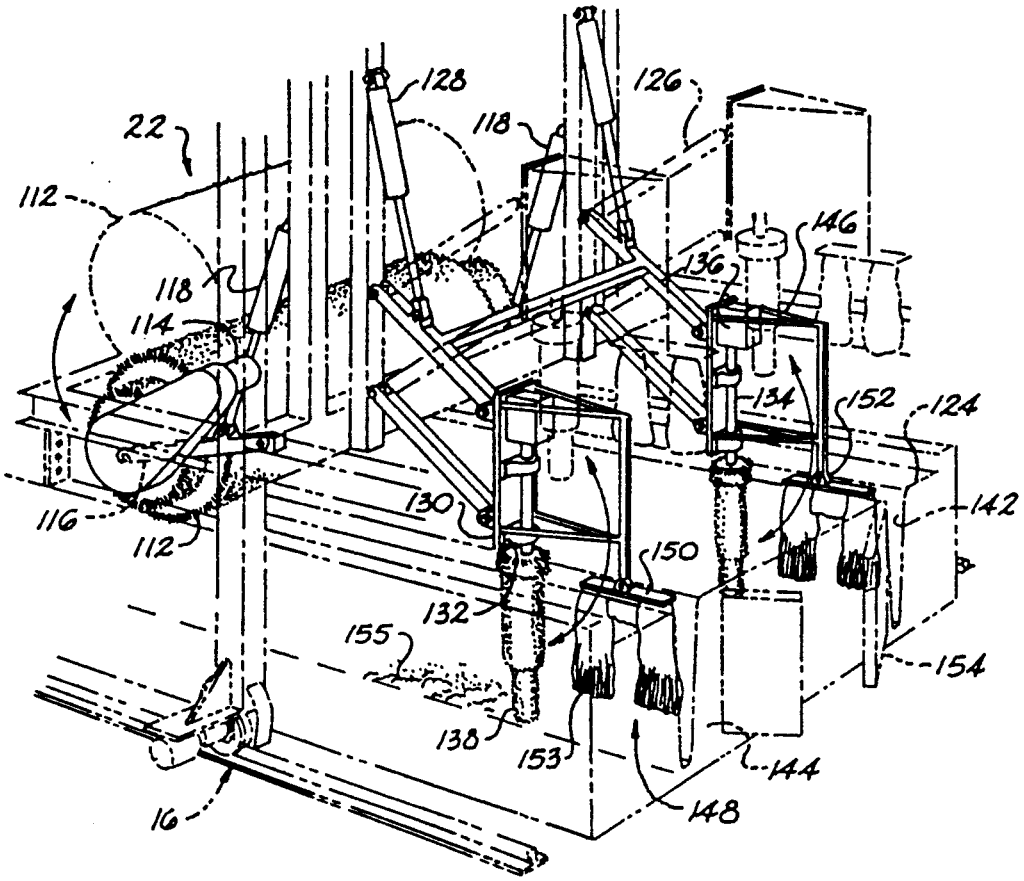
FIG. 5 is a partial perspective view of deck and stem portion cleaning devices provided on the utility machine.

Deck cleaning means 22 includes a horizontally disposed brush 112 which is rotatably powered by a motor 114, as illustrated in FIGS. 2 and 5. Brush 112 is rotatably attached to a pivotal frame 116, which is pivotally attached to frame structure 12. Means for automatically moving pivotal frame 116, such as pressurizable hydraulic actuators 118, are pivotally attached to pivotal frame 116 and to frame structure 12 for moving brush 112 from a raised position, as shown in FIGS. 1, 2, and in phantom in FIG. 5, and a lowered position, as shown in solid lines in FIG. 5. Actuation of brush 112 and hydraulic actuators 118 is controlled by power unit 74 and a control system, generally 120. When in the lowered position, brush 112 is positioned such that bristles 122 provided thereon are in contact with the deck surfaces or deck portion 124 of concrete form 42 for the cleaning thereof. Brush 112 is rotated in the direction, clockwise as shown in the drawings, for removing debris as utility machine moves forward, to the left as is shown in FIG. 2, for keeping the debris in front of utility machine 10 as it moves.

Brush 112, pivotal frame 116, and hydraulic actuators 118 are configured such that as brush 112 wears, and its diameter becomes correspondingly smaller, pivotal frame 116 can be pivoted further downward for allowing bristles 122 of brush 112 to still remain in contact with deck portion 124 for the cleaning thereof.

Stem cleaning means 24 are also illustrated in FIG. 5. Stem cleaning means includes a pivotal frame structure, generally 126, which is movable from a raised position, as shown in phantom lines in FIG. 5, to a lowered position, as shown by solid lines in FIG. 5. Pivotal frame structure 126 is pivotally attached to frame structure 12. Means for automatically moving pivotal frame structure 126, such as pressurizable hydraulic actuators 128, are pivotally attached between frame structure 12 and pivotal frame structure 126 for moving pivotal frame structure 126 between the raised and lowered positions upon actuation thereof. Hydraulic actuators 128 are likewise connected to power unit 74 and control system 126 as are hydraulic actuators 118 discussed above.

Support plates 130 are attached to pivotal frame structure 126 opposite frame structure 12. Support plates 130 include bearing blocks 132 mounted thereon. Mounted for rotation in the bearing blocks 132 are stem brush shafts 134. The stem brush shafts 134 are connected to motors 136 for rotation therewith. Opposite to motors 136, bristled stem cleaning brushes 138 are provided on stem brush shafts 134. Stem cleaning brushes 138 can be of any suitable material and could be those such as manufactured by Hamilton Equipment Company, Inc., of Fort Worth, Texas. When pivotal frame structure 126 is in its lowered position, the bristles of stem cleaning brushes 138 are in contact with the sloping sides 142 of the stem portions, generally 144, of concrete form 42. Debris 155 is removed from stem portions 144 as stem cleaning brushes 138 are rotated while utility machine 10 moves along the concrete form 42.

Also connected to pivotal frame structure stem mop frames 146. Stem mop frames 146 have pivotally attached at their lower ends stem mops, generally 148. Stem mops 148 include plates 150 which are pivotally connected to stem mop frames 146 by pivotal connectors 152. Plates 150 have attached on their other side a mopping element 153 which can be cloth, plastic, or any other suitable material. Stem mops 148 trail behind stem cleaning brushes 138 as utility machine 10 moves along concrete form 42 for the cleaning thereof. Stem mops 148 are movable between a raised position and a lowered position likewise as are stem cleaning brushes 138.

Figure 9:
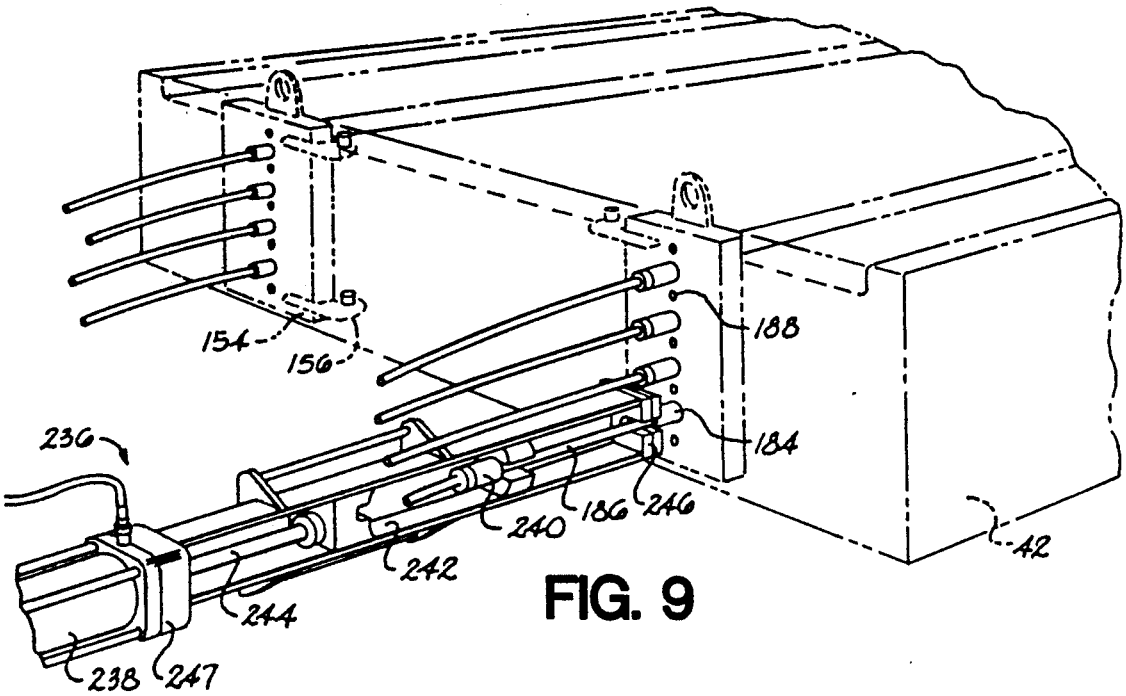
FIG. 9 is a partial perspective view of a tensioning device for tensioning the strands in the concrete forms.

As can be seen from FIG. 9, stem portion doors, or jacking plates 154 are provided at the ends of concrete form 42. Jacking plates 154 are pivotal about the concrete form 42 on hinges 156. Jacking plates 154 can thus be swung away from concrete form 42 for allowing debris 155 to be removed more easily from stem portions 144.

Figure 6:
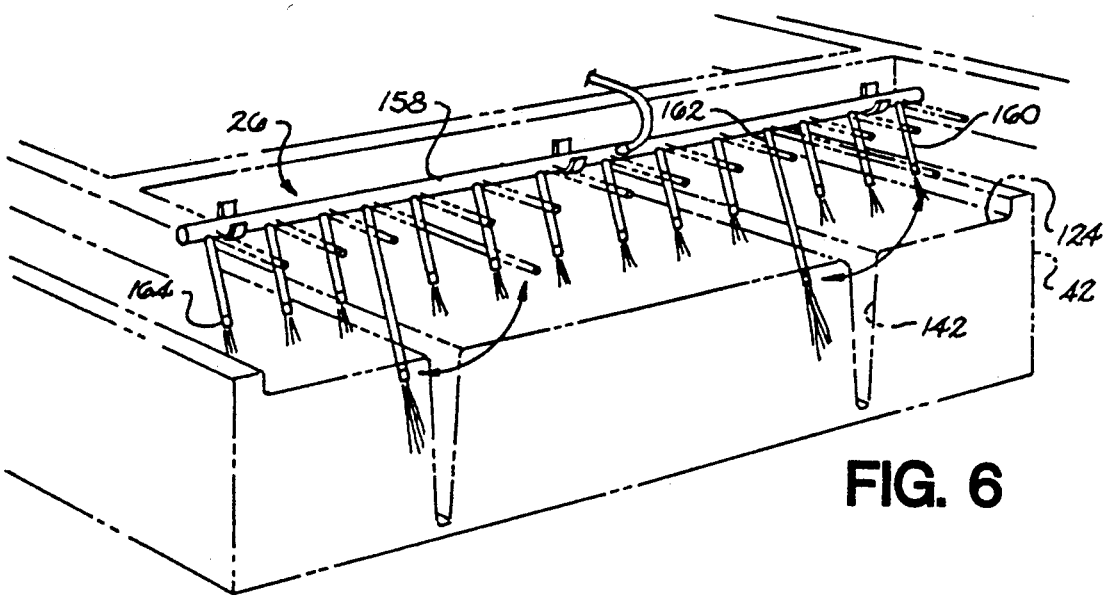
FIG. 6 is a partial perspective view of a concrete form lubrication system provided on the utility machine.

Lubrication means 26 are illustrated in FIG. 6 as including a header conduit 158 having a plurality of short conduits 160 and long conduits 162 extending downwardly therefrom. Each of the conduits 160, 162 are provided with nozzles 164 for emitting a pressurized stream of release or form oil onto deck portion 124 and stem portions 144 of concrete form 42. Although only one nozzle 164 per stem portion 144 is illustrated, it is to be understood that there could be several nozzles 164 per stem portion 144. A tank 166 of such fluid is provided on upper portion 40 of frame structure 12, as seen in FIGS. 1 and 2, and is in fluid communication with header conduit 158. Conventional fluid pressurization means such as a pump (not shown) are provided for pressurizing the fluid from tank 166 which flows into conduits 158, 160, and 162 and onward through nozzles 164 onto concrete form 42. Short conduits 160 are for providing pressurized form oil to deck portion 124, while long conduits 162 are for providing form oil to stem portions 144. As seen in FIG. 4, lubrication means 26 also includes a hand held sprayer 166 for allowing worker 58 to spray bulkheads 52 with form oil. Hand held sprayer 166 is connected to tank 168 shown in FIGS. 1 and 2 by a conduit 170. The form oil allows for a concrete member 172 to be more easily removed from concrete form 42 after hardening. Form oil applied to bulkheads 52 likewise eases the removal thereof from concrete form 42 after hardening of concrete members 172.

Figure 7:
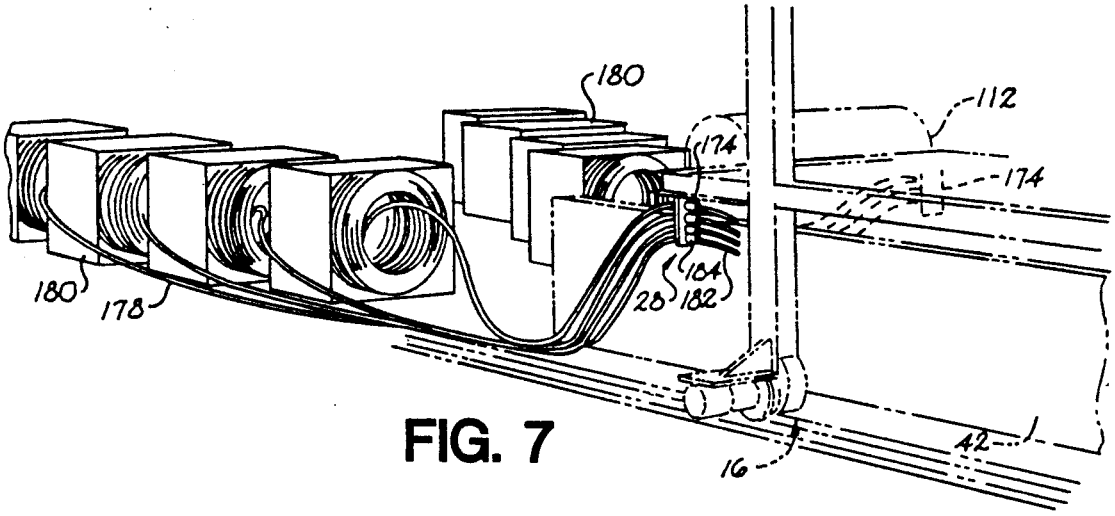
FIG. 7 is a partial perspective view illustrating strand pulling members provided on the utility machine pulling strands from stationary strand coils.

Strand pulling means 28 are illustrated in FIG. 7 and include strand pulling plates 174 which are attached to frame structure 12 adjacent base portion 62 thereof. Strand pulling plates 174 include a plurality of bores 176, shown in phantom in FIG. 8*a*, defined therein. During pulling of strands 178 from strand coils 180, the free ends 182 of strands 178 are inserted through bores 176, and chucks 184 are applied thereto. When utility machine 10 moves towards the right, as shown in FIGS. 2 and 7, strands 178 are pulled from strand coils 180. Upon utility machine 10 reaching the other end of concrete form 42 opposite to strand coils 180, sufficient lengths of strands 178 having thus been pulled for extending the entire length of elongated concrete form 42, the ends of strands 178 adjacent to strand coils 180 are cut to form other free ends 186 opposite free ends 182. Conventional strand chucks 184 are then removed from free ends 182, and free ends 182 are eventually placed into stem portions 144 and inserted through bores 188 of jacking plates 154, which positions the portions of strands 178 near free ends 182 in stem portions 144 of concrete form 42. Chucks 184 are then applied to free ends 182 on the opposite side of jacking plates 154 for retaining free ends 182 from being pulled into stem portions 144.

Strand placement means 30 includes strand placement members 190 which are pivotally attached to a cross-member 192 of base portion 62 of frame structure 12. Pivotal connectors 194 are provided for pivotally attaching strand placement members 190 to cross-member 192. Strand placement members 190 include a plurality of angled slots 196 defined therein for holding the plurality of strands 178. Strand placement members 190 are pivotable between a raised position, as shown in phantom in FIG. 8*a*, and a lowered position, as shown in solid lines in FIG. 8*a*. Retaining bars 198 are pivotally attached to strand placement members 190 and are pivotal between a raised position, as indicated by solid lines in FIG. 8*a*, and a lowered position for retaining strands 178 in angled slots 196, as indicated in phantom in FIG. 8*a*.

After free ends 182 of strands 178 have been secured to jacking plates 154 as discussed above, utility machine 10 is moved to the left, as shown in FIGS. 2 and 8*a*. Prior to the leftward movement of utility machine 10, strand placement members 190 are pivoted to their lowered, substantially vertical position over stem portions 144, and strands 178 are placed in angled slots 196. Retaining bar 198 may be moved to its lowered position for aiding in retaining strands 178 in angled slots 196. As utility machine 10 moves leftward, strands 178 are picked up from the floor surface 200, where they were deposited after being pulled from strand coils 180 by strand pulling plates 174, and are placed in stem portions 144 of concrete form 42. After placing of strands 178 into stem portions 144, strand placement members 190 can again be pivoted upward to their substantially horizontal position out of the way.

Figure 8B:
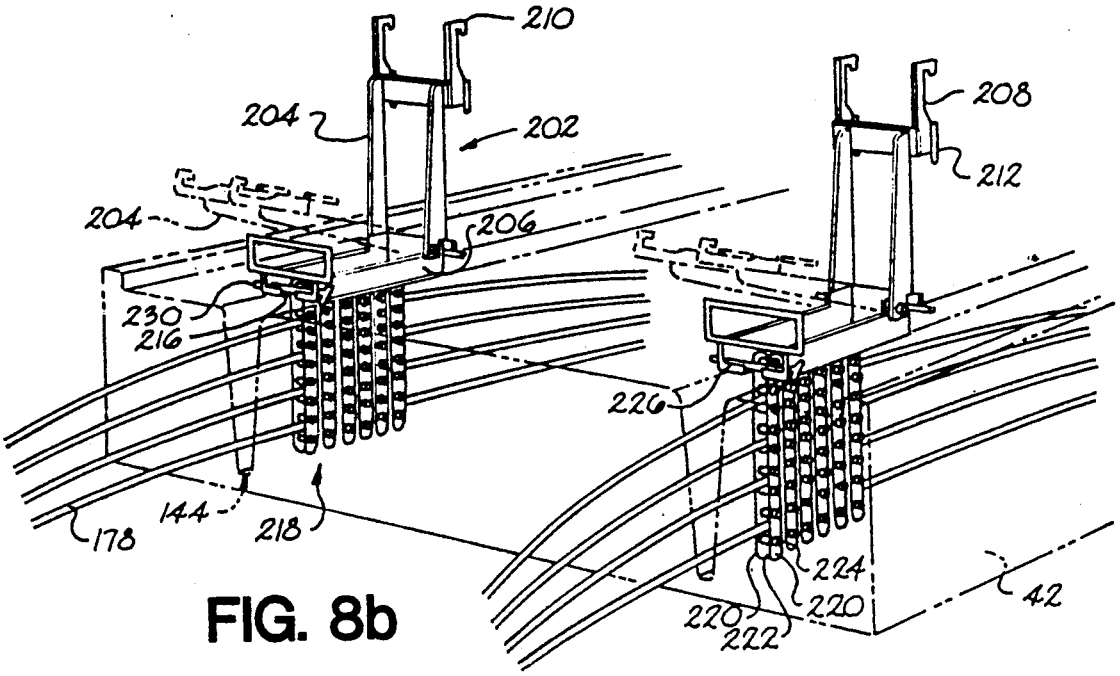
FIG. 8*b* is a partial perspective view of strand guide holders which are attachable to the utility machine and which dispense strand guides therefrom.
Figure 8C:
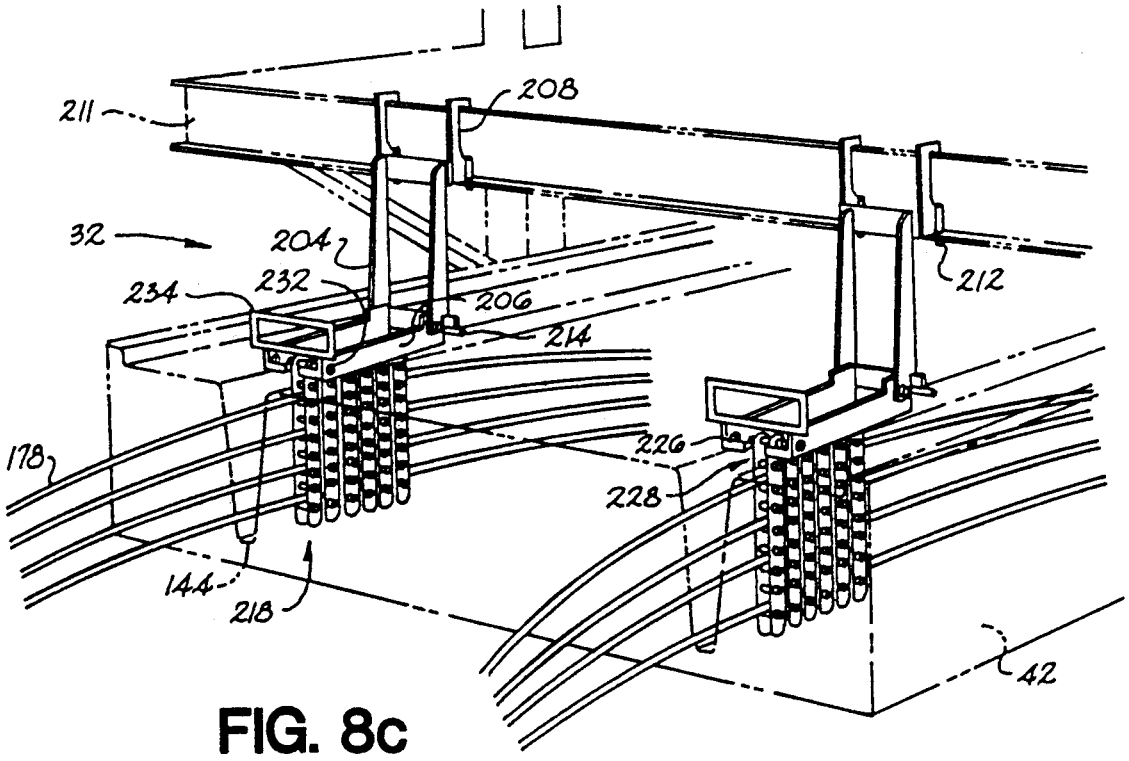
FIG. 8*c* is a partial perspective view of strand guide holders attached to the utility machine, shown in phantom.

Strand guide placement means 32 are illustrated in FIGS. 8*b* and 8*c* and include strand guide dispensing structures, generally 202. Dispensing structures 202 are foldable, having upwardly extending supports 204 and racks 206 pivotally connected thereto. Attachment members 208 are attached to upwardly extending supports 204 and include upper prongs 210 for engaging an upper flange of a cross-member 211, which forms part of base portion 62 of frame structure 12, and lower prongs 212 which engage a lower flange of cross member 211. A pivotal connector 214 is provided between upwardly extending supports 204 and racks 206 for allowing pivotal movement therebetween. Racks 206 are provided with open channels or tracks 216 which extend along the length thereof. Tracks 216 are configured for supporting a plurality of strand guides, generally 218, therein in a side-by-side relationship. Strand guides 218 are conventionally used for positioning and maintaining separation between strands 178 when strands 178 and strand guides 218 are placed in stem portions 144 of concrete form 42.

Strand guides 218 each include two plates 220 which extend substantially parallel to one another. Plates 220 are separated by separators 222 having heads 224 which extend outwardly from both sides of plates 220. The width of tracks 216 are such that they will engage the outer faces of plates 220 only when strand guides 218 are positioned such that tracks 216 receive the outer surfaces of plates 220 between the heads 224 of separators 222. This allows heads 224 to rest on upper surfaces of tracks 216 such that strand guides 218 may be suspended from tracks 216.

Before free ends 182 of strands 178 are secured to a jacking plate 154, the free ends are manually inserted through a series of strand guides 218 suspended above the stem portions 144 by strand guide dispensing structures 202. Because strand guides 218 must be positioned along concrete form 42 at various positions which correspond to the ends of concrete members 172 which are to be formed, strand guide dispensing structures 202 allow for strand guides 218 to be dispensed along stem portion 144 as utility machine 10 moves therealong. For doing this, racks 206 are provided with upwardly extending ridges or lips 226 which are adjacent a strand guide dispensing outlet, generally 228, at the trailing end of racks 206. A pin 230 is also provided in bores 232 adjacent the trailing ends of racks 206 for engaging an upper portion of the strand guides 218 which are adjacent strand guide dispensing outlets 228. When it is desired to place a strand guide 218 in a stem portion 144, pin 230 is removed from bores 232, and the strand guide adjacent the strand guide dispensing outlet 228 is given a slight upward push manually such that the heads 224 of the uppermost separators 222 clear upwardly extending projections or lips 226 for dispensing the strand guide 218 from the rack 206 as the utility machine moves along concrete form 42.

When removed from cross-member 211, strand guide dispensing structures 202 may be folded such that upwardly extending supports 204 rest above racks 206, as shown in phantom in FIG. 8*b*, for giving strand guide dispensers 202 a low profile. This allows for utility machine 10 to drive over strand dispensing structures 202 when necessary even when strand guide dispensing structures 202 are loaded with strand guides 218 having strands 178 threaded therethrough. Handles 234 are provided strand guide dispensing structures 202 for allowing easier manipulation thereof.

Strand tensioning means 34 includes a conventional strand tensioning ram 236, as shown in FIG. 9, which could be, for example, one similar to that manufactured by Tuckers, Inc. of Leesburg, Florida. Strand tensioning ram 236 includes a hydraulic cylinder 238 which is connected to power unit 74. After strands 178 have been pulled the length of concrete form 42 and stem portions 144, after each end of strands 178 have been secured to a respective jacking plate 154 by chucks 184, and after strand guides 218 have been spaced appropriately along stem portion 144, strands 178 are ready for tensioning. As shown in FIG. 9, each free end 186 of strands 178 are first provided with an additional chuck 240 which is engageable with a pulling chamber 242 connected to piston shaft 244 of hydraulic cylinder 238, such that upon actuation of hydraulic cylinder 238, piston shaft 244 is moved towards the left, as illustrated in FIG. 9. Meanwhile, a bracing structure 246 is positioned against a backside of chuck 184 adjacent jacking plate 154. The internal gripping mechanism of chucks 184, 240 allow for strands 178 to be pulled therethrough in one direction only, namely to the left as illustrated in FIG. 9, but not in the other direction. Thus, the pulling of additional chuck 240 causes for tension to be applied in that particular strand 178 and allows for the strand to stay tensioned by action of chuck 184. This is because chuck 184 will not allow the strand to go backwards therethrough and on through jacking plate 154 after strand tensioning ram 236 has been removed from that strand. Strands 178 are tensioned one by one in this manner.

Proper tensioning of strands 178 is accomplished by subjecting hydraulic cylinder 238 with a predetermined pressure, which causes a corresponding elongation in the strand 178 being pulled. Proper tensioning of the strand may be checked by the amount of elongation of the strand, or alternately, hydraulic cylinder 238 may be provided with a load cell 247 connected to control system 120 for allowing the force applied to the strand to be measured directly on a control panel (not shown) of control system 120. Load cell 247 is connected between hydraulic cylinder 238 and bracing structure 246 and allows for the tension in a strand to be measured directly in pounds of force on the control panel. A printer (not shown) could be provided for printing out a record of the tension applied to the strands 178 of a concrete beam 172. Typically, strands 178 are tensioned to upwards of 30,000 pounds of force.

Hydraulic cylinder 238 is normally positioned on upper portion 40 of frame structure 12 and is supported by racks 248, as shown in FIGS. 1 and 2. When it is desired to tension strands 178, hydraulic cylinder 238 is removed from racks 248 through use of crane means 20 and is connected to strands 178.

Figure 10:
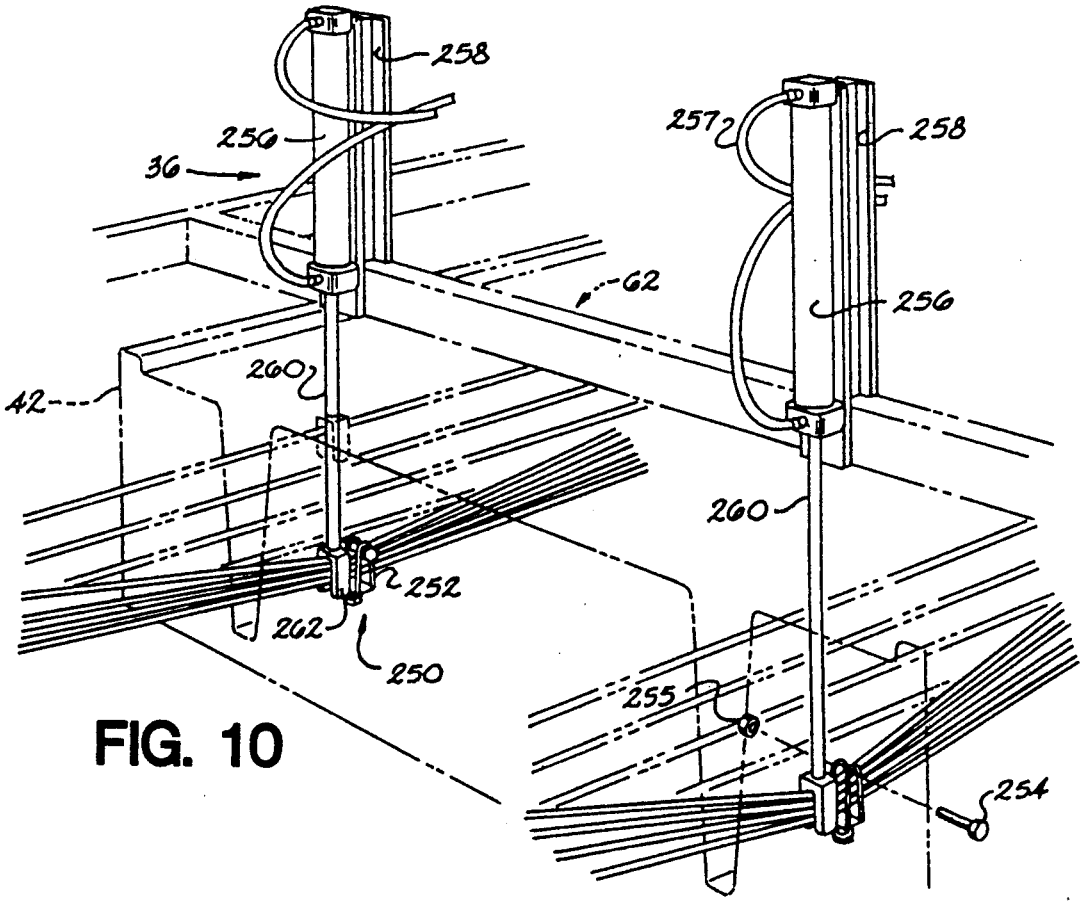
FIG. 10 is a partial perspective view of strand depressing devices attached to the utility machine for depressing strands into the stem portions of the concrete forms.

After tensioning of strands 178, they are typically depressed downwardly into the stem portions 144 and held there by hold-downs, generally 250. Hold-downs 250 include a strand receiver 252 which is bolted to the bottom surface of stem portions 144. A retaining bolt 254 and accompanying nut 255 are provided in the strand receiver 252 after strands 178 have been depressed therein for retaining strands 178 in the strand receiver 252, as shown in FIG. 10.

Strand depressing means 36 include two substantially vertically extending hydraulic actuators 256 which are attached to vertical frame members 258 of frame structure 12. Hydraulic fluid supply lines 257 are connected to actuators 256. Rods 260 are extendable from hydraulic actuators and include strand depressing yokes 262 on the ends thereof. Rods 260 are movable from a raised position, as illustrated in phantom FIG. 10, and a lowered, strand depressing position, as illustrated in solid lines of FIG. 10. While actuators 256 have been illustrated as being hydraulic, it is understood that other types of actuators such as pneumatic, electrical, or mechanical could also be used.

Strands 178 are depressed by yokes 262 on one side or the other of strand receivers 252 for allowing retaining bolts 254 to be inserted in strand receivers 252 while strands 178 are depressed. The depressing of strands 178 in concrete form 42 is generally performed in a particular pattern which requires for the strands 178 which are to be embedded in the various concrete members 172 to be depressed in a particular pattern. This is facilitated by the fact that utility machine 10 is readily movable back and forth along concrete form 42 for carrying out the particular pattern required for depressing strands 178. Because of the weight of utility machine 10, strands 178 can be depressed using hydraulic actuators 256 without the need for anchoring utility machine 10 down in some manner, as is often required when using conventional devices for depressing the strands.

After the strands 178 have been depressed into stem portions 144, sheets of reinforcing material such as wire fabric (not shown) are placed by hand in predetermined positions in stem portions 144 for subsequent embedment into and corresponding strengthening of concrete members 172. Utility machine 10 may be used for transporting and supporting workers and sheets of reinforcing material as the sheets of reinforcing material are placed in various portions along the concrete form. Side weld fixtures such as side weld plates may also be provided about the edges of the deck portion 124 of concrete form 42.

Figure 11:
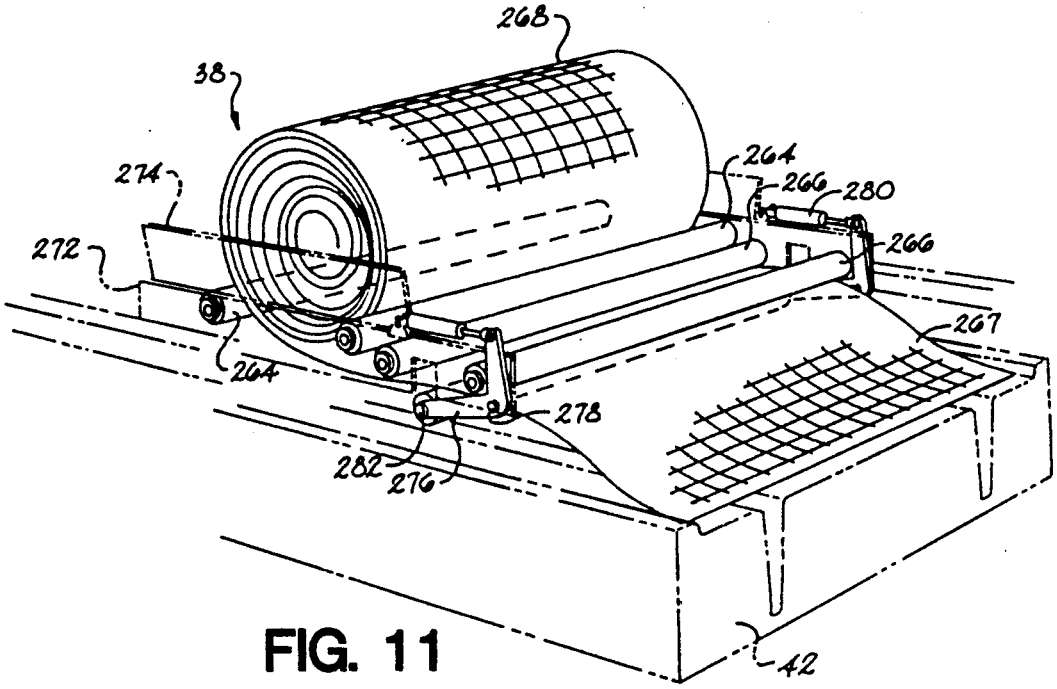
FIG. 11 is a partial perspective view of a deck wire dispensing device provided on the utility machine for dispensing deck wire onto the deck portions of a concrete form.

Deck reinforcing material such as wire fabric 267 is also provided on deck portion 124 of concrete form 42 for embedment in the concrete prior to its being poured into concrete form 42. As illustrated in FIGS. 1, 2, and 11, deck reinforcing material dispensing means 38 includes two transversely extending deck wire roll support rollers 264 which are spaced apart from one another and which are mounted for rotation. Also included are two transversely extending straightening rollers 266 which are spaced apart from one another and which are also mounted for rotation. Support rollers 264 are for rotatably supporting a roll of deck wire 268 thereon as frame structure 12 moves along concrete form 42 away from a point of anchoring of a free end of the roll of deck wire 268. The anchoring of the free end is not illustrated, but can be accomplished by conventional means such as by chaining the free end to an end of concrete form 42. Extending alongside the ends of the roll of deck wire 268 are frame members 272, 274 which aid in retaining the roll of deck wire 268 in proper position on support rollers 264 and which also provide attachment structures to which support rollers 264 and straightening rollers 266 can be rotatably mounted.

Crank arms 276 are pivotally attached to frame members 272 by a pivotal connector 278. One end of crank arms 276 is attached to actuators 280 which can be hydraulic cylinders supplied pressurized hydraulic fluid by power unit 74. Attached to the other end of crank arms 276 is an intermediate transversely extending roller 282 which is rotatably mounted to crank arm 276. Actuators 280 allow for crank arms 276 to be pivoted about frame members 272 such that intermediate roller 282 may be brought between straightening rollers 266 for contacting and bending the deck wire as it passes beneath straightening rollers 276. Actuators 280 can also pivot crank arms 276 such that intermediate roller 282 is out of contact with the deck wire as it unrolls from the roll of deck wire 268. Crank arms 276 can be pivoted such that intermediate roller 282 bends the deck wire sufficiently to compensate for the curvature of the deck wire as it existed on the roll 268. Thus, the purpose of straightening rollers 276 and intermediate roller 282 is to remove such curvature in the deck wire so that when the deck wire is placed upon deck portion 124, it is substantially straight and flat. As the roll of deck wire 268 becomes smaller during the paying out of deck wire therefrom, actuators 280 may move crank arms 276 to bend the deck wire to compensate for the decreasing radius of curvature of the deck wire coming off of the roll 268.

The present invention also includes a method of removing a concrete member 178 from the concrete form 42 and for preparing the concrete form 42 for the receipt of concrete for forming another concrete member 172.

The method of the present invention will be discussed with the assumption that the elongated concrete form 42 already has hardened concrete members 172 therein and is covered by concrete form cover 88. The method would then involve rolling up concrete cover 88 with reel means 18 as utility machine 10 passes along concrete form 42. Tensioned strands 178 passing through bulkheads 52 are then cut with manual cutters (not shown) or hydraulically powered cutters (not shown) which could be connected to the hydraulic system of machine 10. Bulkheads 52 are then removed from concrete form 42 using crane means 20. Bulkheads 52 are then moved to racks 50 with crane means 20 where they are cleaned and provided with form oil manually with hand-held sprayer 168.

After removing the bulkheads 52 and concrete members 172 from concrete form 42, cleaning of deck portion 124 of concrete form 42 is accomplished with deck cleaning means 22, which includes using rotating brush 112. Rotating brush 112 is brought into a lowered, deck cleaning position for brushing deck portion 124 with bristles 122 as utility machine 10 passes along concrete form 42. Cleaning of the stem portions 144 of concrete form is accomplished simultaneously with the cleaning of the deck portion 124 by stem cleaning means 24. Stem cleaning means 124 includes stem cleaning brushes 138 which are rotated to brush sloping sides 142 of stem portions 144 with bristles 140 as utility machine 10 passes above concrete form 42. Stem mops 148 trail behind stem cleaning brushes 138 and clean out the lower surfaces of stem portions 144 as utility machine 10 passes above concrete form 42. Jacking plates 154 may be swung open so that debris moved along in stem portions 144 may be moved outside of concrete form 42.

After cleaning of concrete form 42, deck portion 124 and stem portions 144 of concrete form 42 are lubricated with release or form oil with lubrication means 26. Lubrication means 26 includes nozzles 164 which spray form oil on deck and stem portions 124, 144 as utility machine 10 moves along concrete form 42.

Pulling of strands 178 for placement into stem portions 144 of concrete form 42 is accomplished by strand pulling plates 174, to which free ends 182 of strands 178 are secured. Utility machine 10 is moved along concrete form such that strands 178 are pulled from strand coils 180. As utility machine 10 moves down along concrete form 42, strands 178 are pulled thereby with strand pulling plates 174. After the proper lengths of strands 178 have been pulled, they are cut from strand coils 180 to form free ends 186. Free ends 182 are inserted through a plurality of strand guides 218, which are suspended from racks 206 of strand guide dispensing structures 202, and are inserted through bores 188 provided in jacking plates 154. Chucks 184 are then attached to free ends 182, and strands 178 are placed in angled slots 196 of strand placement members 190.

The placing of strands 178 in stem portions 144 occurs when utility machine 10 again moves down elongated concrete form 42 away from jacking plates 154 where free ends 182 are secured. As utility machine 10 moves in this direction, strand guides 218 may also be positioned along stem portions 144 of concrete form 42 with the removing thereof from racks 206 over lips 226 and into stem portions 144.

Also, as strand guides 218 are positioned, crane means 20 can be used to remove bulkheads 52 from racks 50 and for depositing bulkheads 52 into concrete form 42 such that strand guides 218 are received in slots 284 of bulkheads 52. Strand guides 218 are secured to bulkheads 52 in slots 284 by bolts (not shown) or by other conventional attachment means.

Once utility machine 10 has reached the end of concrete form 42 opposite where free ends 182 are attached to jacking plates 154, the other free ends 186 of strands 178 are inserted in bores of a jacking plate 154 there. Chucks 184 are then provided on the free ends 186.

Tensioning of strands 178 takes place one by one using strand tensioning ram 236 in a manner as discussed above.

After tensioning of strands 178 in concrete form 42, the depressing of strands 178 takes place using hydraulic actuators 256 which act through yokes 262 to force strands 178 into strand receivers 252, after which time retaining bolts 254 are inserted therein for retaining strands 178 in the depressed configuration.

Sheets of reinforcing material may be provided manually in certain locations of stem portions 144 of concrete form 42. Also, weld fixtures or weld plates may be placed along the edges of deck portion 124 of concrete form 42, or, alternately, such weld fixtures or weld plates could be placed in deck portion 124 after pouring of concrete therein.

The unrolling of deck reinforcing material such as deck wire 267 onto deck portion 124 of concrete form 42 is accomplished using deck wire dispensing means 38, which includes straightening rollers 266 and pivotal intermediate roller 282 which contact deck wire 267 being unrolled from the roll of deck wire 268 to straighten it before being placed on deck surface 124 of concrete form 42. The free end of the deck wire 267 is anchored to one end of concrete form 42, and utility machine 10 then moves along concrete form 42 away from the point where the deck wire 267 is anchored to concrete form 42. As utility machine 10 moves, the roll of deck wire 268 is unrolled while supported on support rollers 264, the portion unrolled being straightened by straightening rollers 266, 282, as discussed above, prior to placement on deck portion 124. During straightening, roller 282 will be moved from its lowered position illustrated in FIG. 11 to a raised position in contact with the deck wire for straightening it as it is unrolled.

Subsequent to the pouring of concrete into concrete form 42, covering of the freshly poured concrete is accomplished by dispensing concrete form cover 88 using reel means 18 as utility machine 10 moves above concrete form 42.

Figure 12:
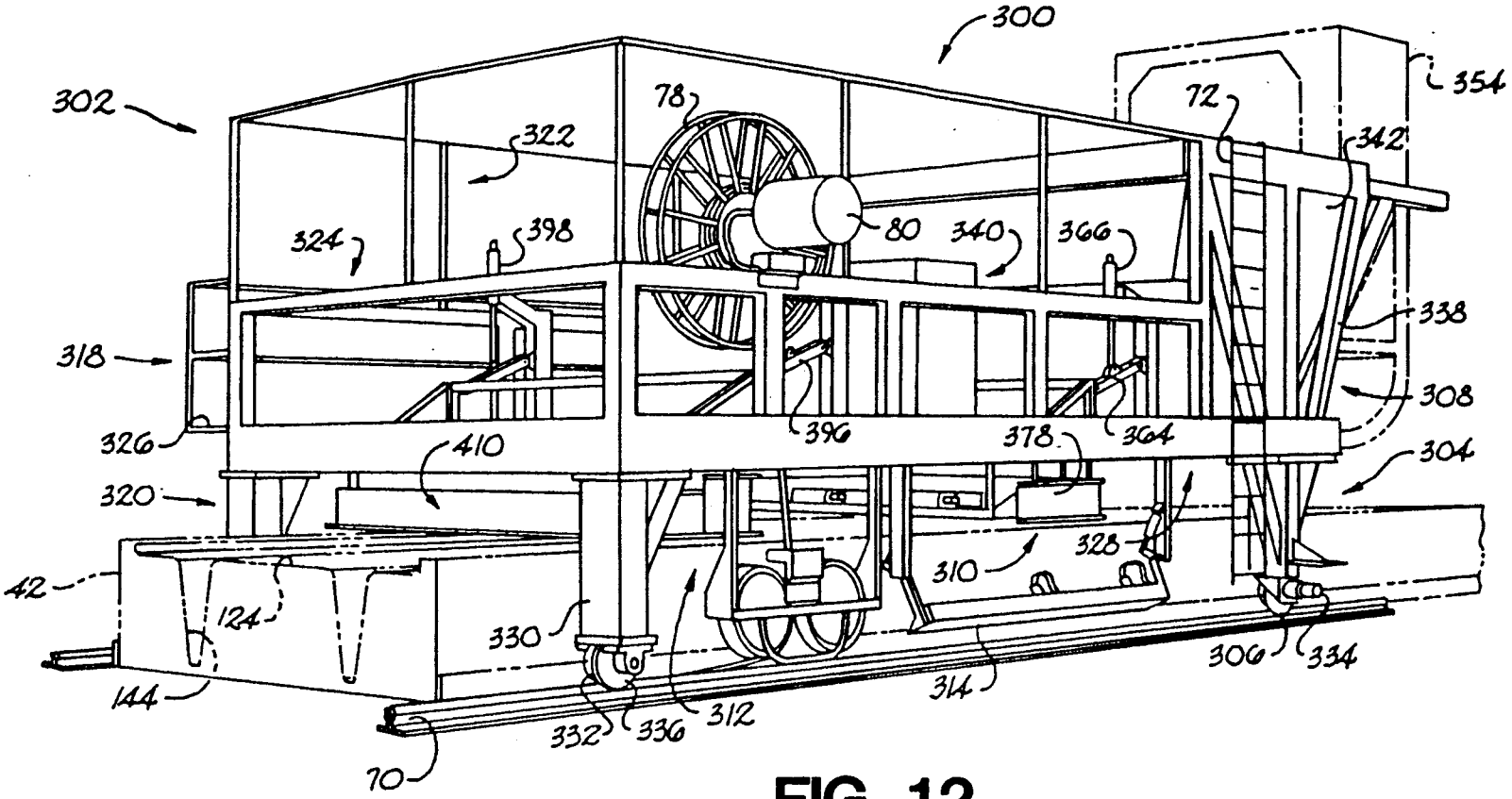
FIG. 12 is a perspective view of a concrete pouring machine constructed in accordance with the present invention.
Figure 13:
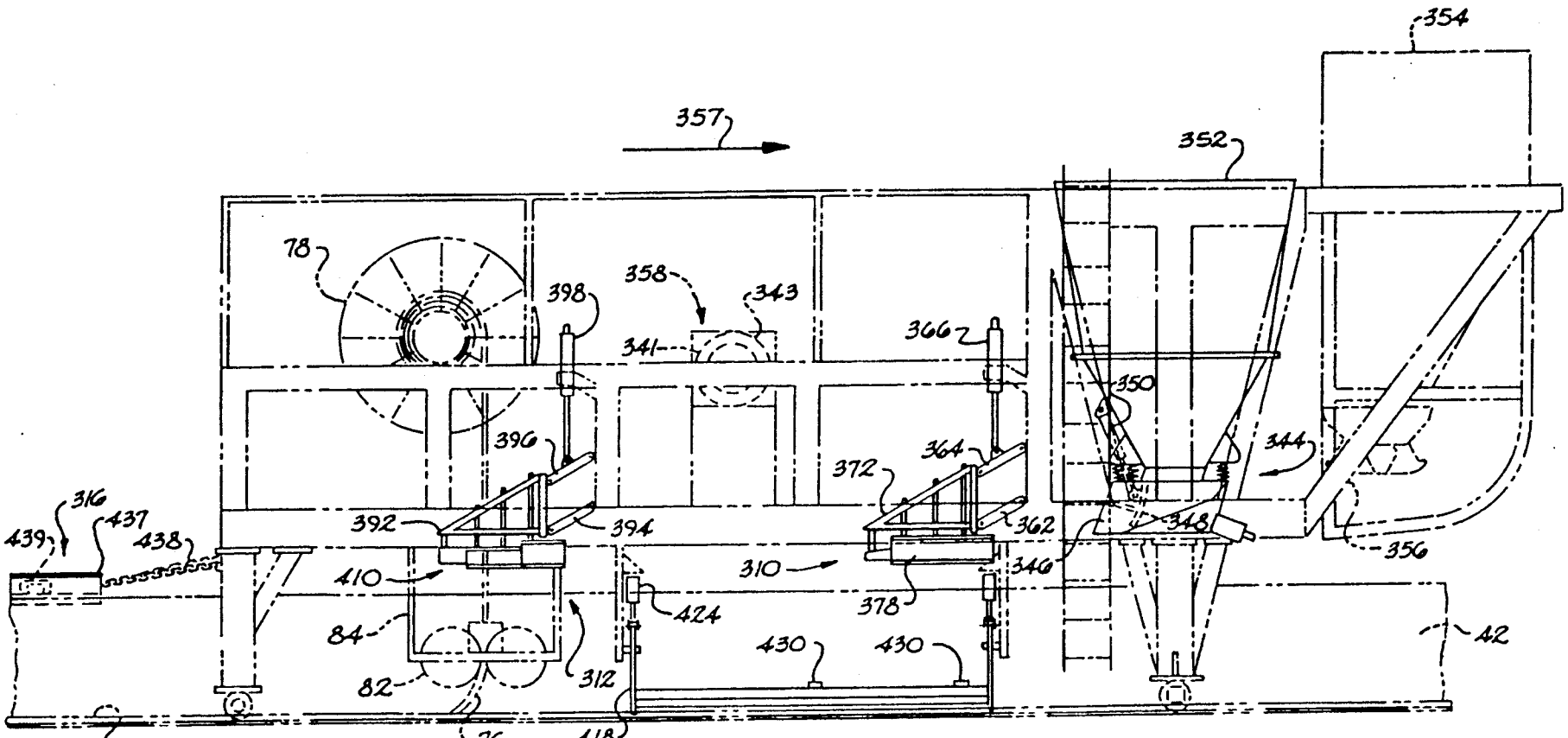
FIG. 13 is a side elevational view, partially in phantom, illustrating a concrete pouring machine constructed in accordance with the present invention.

Turning to FIGS. 12–17, a pouring machine constructed in accordance with the present invention is designated generally in FIG. 12 by the reference character 300. Features common to both utility machine 10 and pouring machine 300 are given like reference numerals. As illustrated in FIGS. 12 and 13, pouring machine 300 includes a frame structure, generally 302, support means, generally 304, motive means, generally 306, concrete supply means, generally 308, first concrete spreader means, generally 310, concrete compaction means, generally 312, concrete form vibration means, generally 314, and second concrete spreader means, generally 316.

Frame structure 302 of pouring machine 300 is constructed similarly as is frame structure 12 of utility machine 10 and includes an upper portion, generally 318, which is positionable above concrete form 42 and a lower portion, generally 320, which straddles concrete form 42. Vertical support members 322 and horizontal support members 324 are included in upper portion 318 and are preferably steel members attached to each other by welding, bolts, or other suitable fastening means. Upper portion 318 is provided a platform 326, as partially shown in FIG. 15, for supporting workers thereon during operation of pouring machine 300.

Lower portion 320 of pouring machine 300 includes support means 304 having vertically extending supports 60 which extend downwardly from a base portion, generally 328, of frame structure 302. Vertically extending supports 330 are spaced on either side of concrete form 42 for allowing pouring machine 300 to move therealong on rails 70.

Motive means 306 include wheels 332 which are rotatably connected to hydraulic motors 334. Hydraulic motors 334 may be provided any number of wheels 332 having flanges 336, however, in the preferred embodiment, hydraulic motors 334 are provided the two wheels 332 adjacent the forward end 338 of pouring machine 300. A power unit, generally 340, is provided on upper portion 318 of frame structure 302. Power unit 340 preferably comprises a hydraulic pump, generally 341, driven by an electric motor, generally 343, although other suitable power units could be provided. Hydraulic motors 334 are connected to power unit 340 for rotating wheels 332.

Concrete supply means 308 includes two hoppers 342 provided on the forward end 338 of pouring machine 300. Hoppers 342 are of conventional design and include vibratory dispensing outlets, generally 344, which vibrate to evenly dispense concrete from hoppers 342 through chutes 346, which are directed over stem portions 144, and into concrete form 42. Hoppers 342 could be those such as sold by Skako, Inc., of Hayward, California. A pivotal door 348 is provided the vibratory dispensing outlets 344 for permitting concrete to flow through chutes 346 when raised by an actuator 350 and for shutting off the flow of concrete from chutes 346 when pivotal door 348 is moved downwardly by actuator 350.

Concrete is supplied to hoppers 342 through openings 352 provided in the top portions thereof. A concrete supply container 354 may be used to supply hoppers 342 with concrete if desired. Concrete supply container 354 is shown in phantom in FIGS. 12 and 13 and includes a supporting frame structure 356 which may be attached to pouring machine 300 if desired for allowing concrete supply container 354 to be transported from one place to another. Typically, during use concrete supply container 354 is handled by an overhead crane (not shown) located above concrete form 42.

As pouring machine 300 moves along concrete form 42, to the right as shown by arrow 357 in FIG. 13, concrete is dispensed from hoppers 342 at a rate which is controllable at a control station 358. A power cord reel 78 is attached to frame structure 302 and performs as discussed above with regards to utility machine 10 to unwind and wind up power cable 76, using power cable guides 82, as pouring machine 300 moves along concrete form 42.

Figure 14:
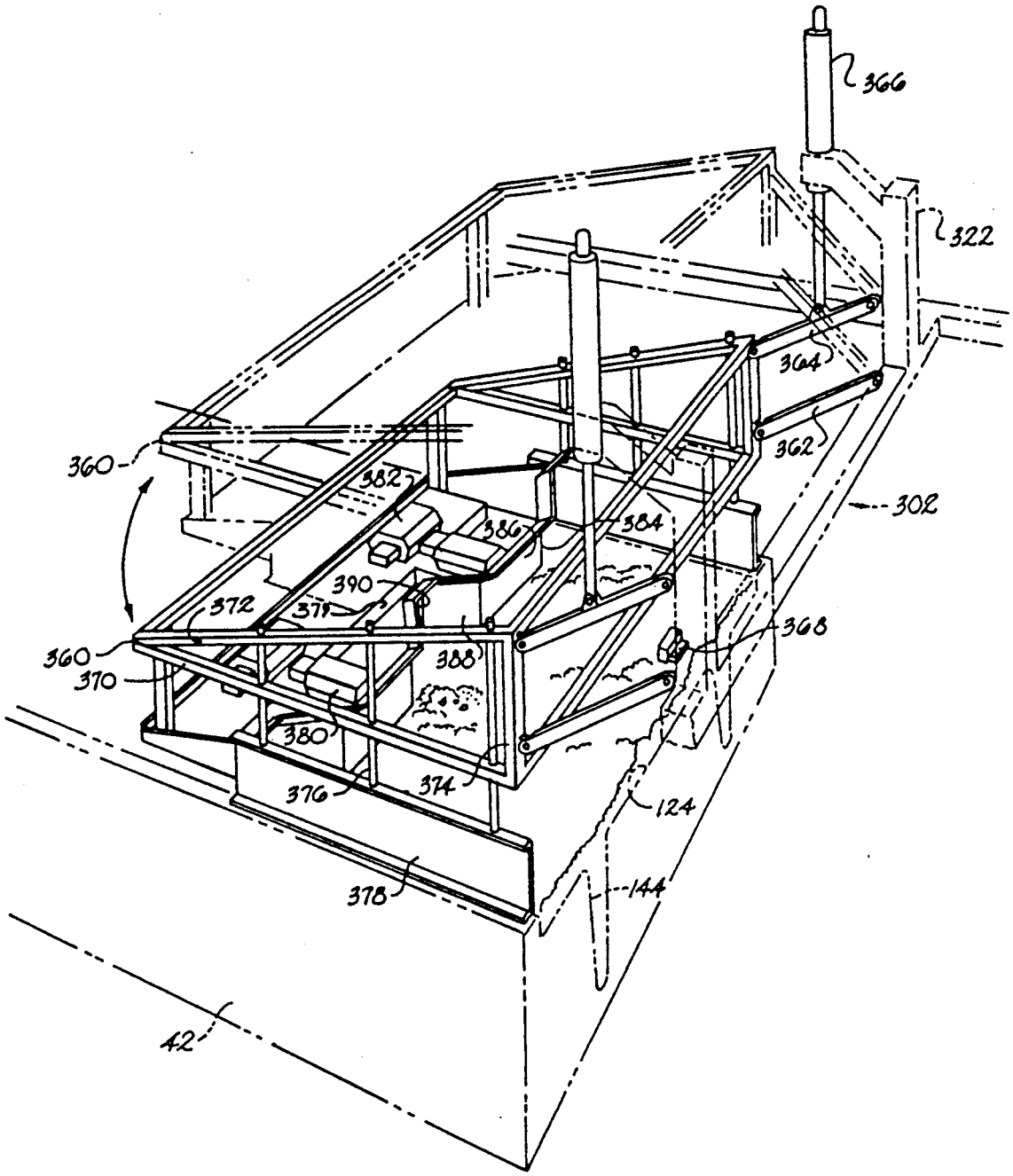
FIG. 14 is a partial perspective view of a vibrating concrete spreader provided on the pouring machine.

First concrete spreader means 310 is illustrated in more detail in FIG. 14 and includes a frame 360 which is pivotable about vertical support members 322 between a lowered, concrete spreading position, as shown by solid lines in FIG. 14, and a raised position, as shown in phantom in FIG. 14. Frame 360 is pivoted by pivotal linkages 362 and 364. Pivotally connected to pivotal linkages 364 are actuators 366 which are attached to frame structure 302. A proximity switch 368 is attached to a vertical support member 322 for sensing the relative position of pivotal linkages 362 with respect to vertical support members 322. Proximity switch 368 is connected to control station 358 for communicating to control station 358 the position of pivotal linkage 362, and, accordingly the position of frame 360.

Frame 360 includes horizontal frame members 370, angled frame members 372 and vertical frame members 374 which are connected together by welding, or some other suitable fastening means. Extending downwardly from frame 360 are vertical rods 376 which are connected at their lower ends to a vibrating frame 378 and which slidingly engage frame 360 for floating, vertical movement relative thereto as machine 300 moves along form 42. Vibrating frame 378 includes four hydraulically powered vibrators 380, 382 mounted on one side of a plate member 379 such that during the operation thereof, the other side of plate member 379 of vibrating frame 378 is vibrated in a manner for contacting and spreading concrete about concrete form 42, as pouring machine 300 moves along. It is to be understood that vibrators 380, 382 could also be pneumatically powered, electrically powered, gas powered, or the like. Vibrators 380 are oriented perpendicular to vibrators 382 for further enhancing the vibrational spreading of concrete in concrete form by plate member 379 of vibrating frame 378. Hydraulic actuators 380, 382 are connected to power unit 340. A "bull-nosed" profile, generally 384, is provided vibrating frame 378 and includes projecting portions 386, positioned over stem portions 144, having angled members 388 extending rearwardly therefrom to recessed portions 390, positioned over deck portions 124. Such a bull-nosed profile serves to improve the spreading of concrete about the deck and stem portions 124, 144 of concrete form 42.

Figure 15:
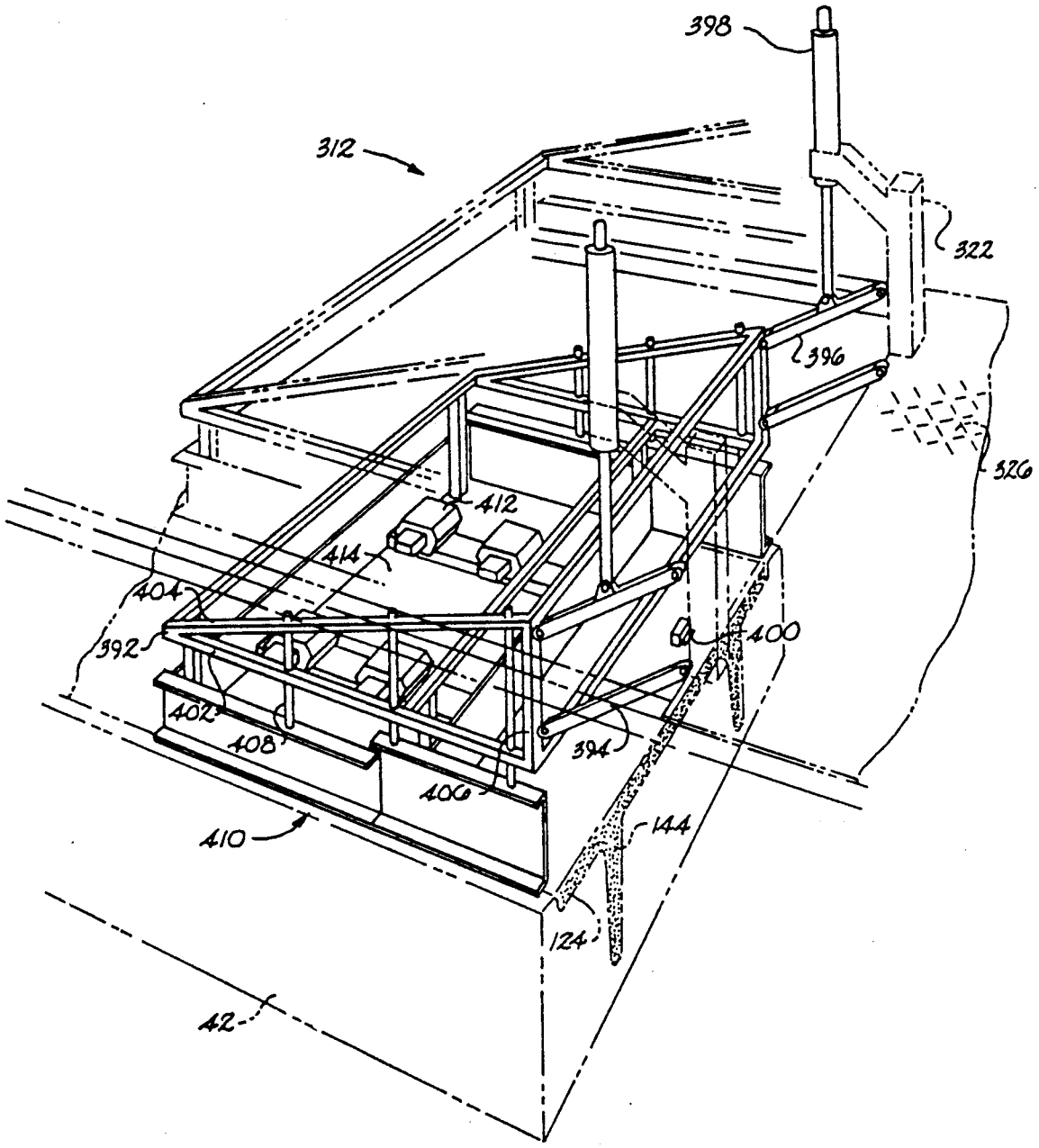
FIG. 15 is a partial perspective view of a vibrating concrete compactor provided on the pouring machine.

Concrete compaction means 312 is illustrated in FIG. 15 and includes a frame 392 which is pivotally connected to vertical support members 322 by pivotal linkages 394 and 396. Actuators 398 are pivotally attached to pivotal linkages 396 and are fixedly attached to frame structure 302. Actuators 398 move frame 392 between a lowered position for compacting concrete in concrete form 42, as shown by the solid lines in FIG. 15, and a raised position, as shown by the phantom lined position in FIG. 15. A proximity switch 400 is provided on a vertical support member 322 for sensing the relative position of pivotal actuators 396 relative thereto. Proximity switch 400 is connected to control station 358 for allowing the position of frame 392 to be monitored.

Frame 392 includes horizontal frame members 402, angled frame members 404, and vertical frame members 406 which are connected by welding or other suitable fastening means. Downwardly extending vertical rods 408 are attached to frame 392 and to a vibrating frame, generally 410. Vertical rods 408 slidingly engage frame 392 for floating, vertical movement relative thereto as machine 300 moves along form 42. Vibrating frame 410 is provided with four hydraulic vibrators 412 which are connected to power unit 340. Vibrating frame includes a bottom plate member 414 which vibratingly contacts concrete in concrete form 42 for compacting same.

The respective heights of first concrete spreader means 310 and concrete compaction means 312 can be controlled independently of one another from control station 358 for providing optimum spreading and compacting of the concrete being discharged from chutes 346 of hoppers 342 as pouring machine 300 moves along concrete form 42.

Figure 16:
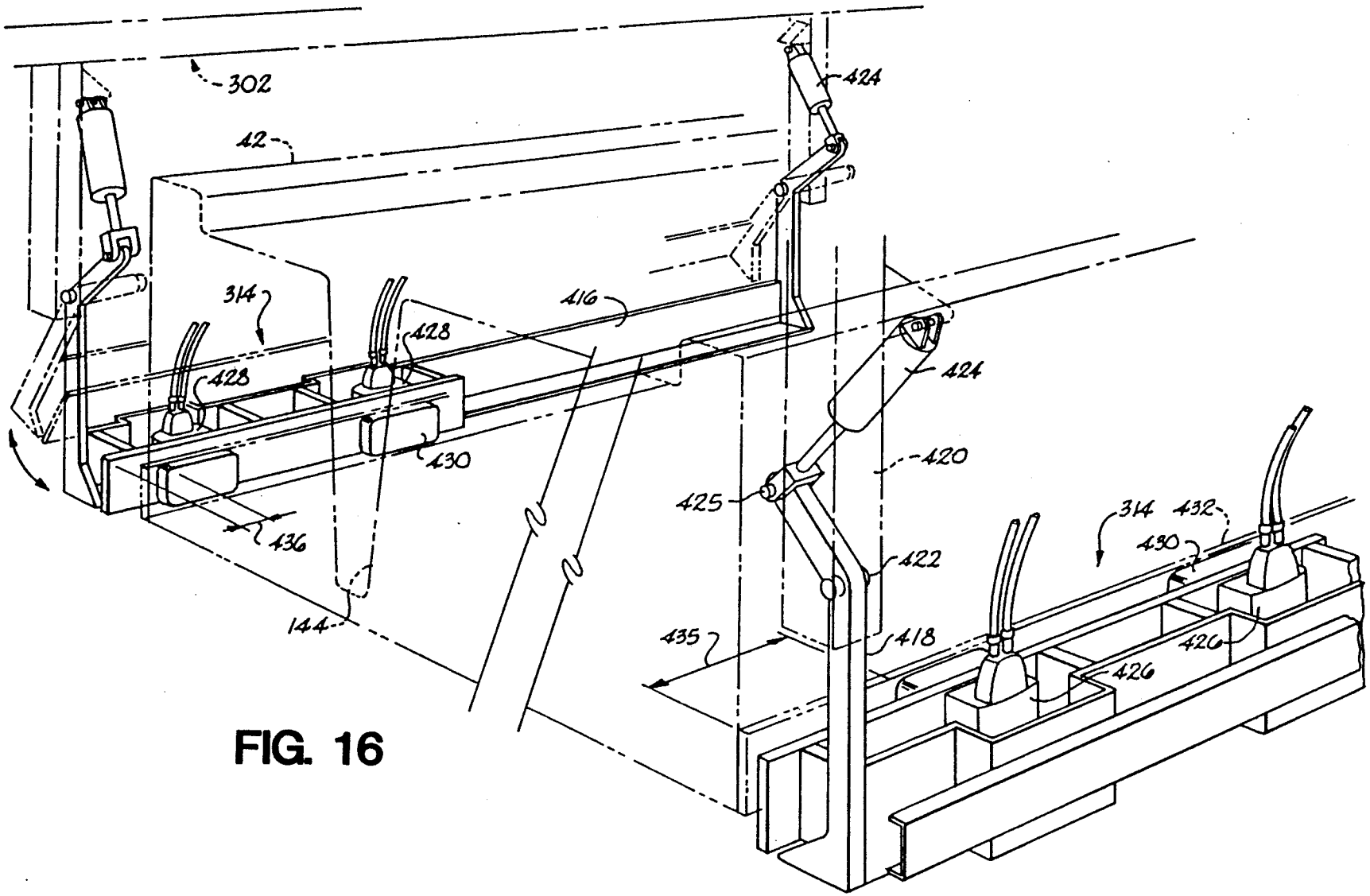
FIG. 16 is a partial perspective view of a concrete form vibration system provided on the pouring machine.

Concrete form vibration means 314 is illustrated in FIG. 16 and includes longitudinal frame members 416 connected to pivotal arms 418. Pivotal arms 418 pivot about vertical members 420 which extend downwardly from base portion 330 of the frame structure 302. Pivotal arms 418 are connected to vertical members 420 with pivotal connectors 422. Pivotal arms 418 are pivotally attached to actuators 424 by pivotal connectors 425 which allow longitudinal frame members 416 to be pivoted between a concrete form vibrating position, as shown in solid lines in FIG. 16, and a withdrawn position, as shown in phantom in FIG. 16.

Figure 18:
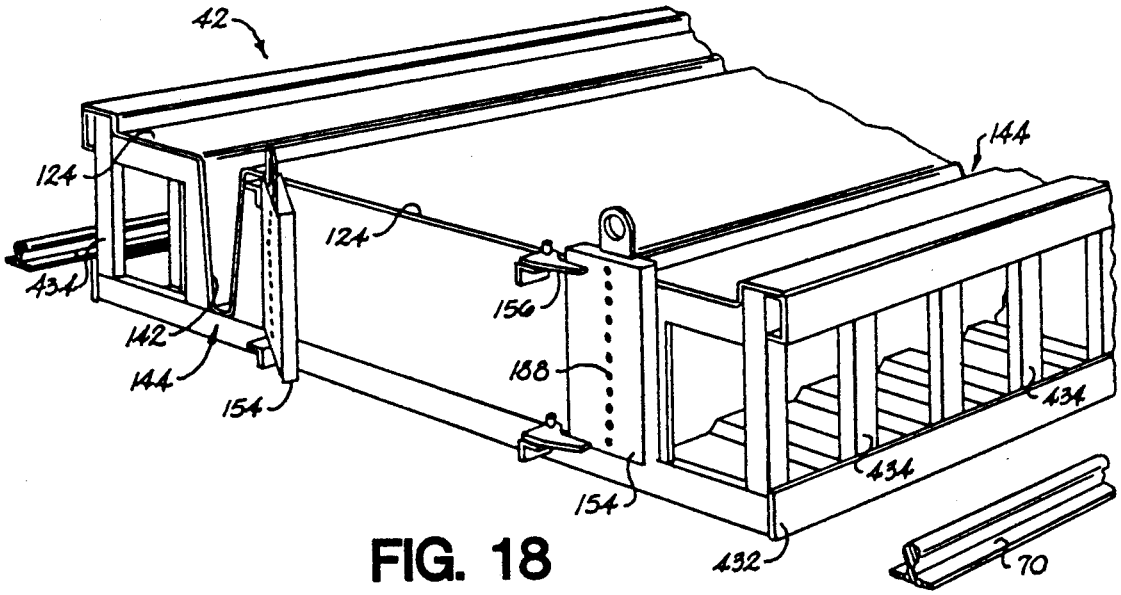
FIG. 18 is a partial perspective view of an end of a concrete form having a jacking plate pivoted to an open position.

Hydraulic vibrators 426, 428 are attached to longitudinal frame members 416. It is understood that pneumatic vibrators, electrical vibrators, gas vibrators, or the like could be used instead of hydraulic vibrators 426. Hydraulic vibrators 426, 428 are provided with electromagnetic plates 430 which engage a steel band 432 connected to and running the length of concrete form 42. Uniformly spaced along the outside of concrete form 42 and connected thereto are substantially vertically extending form supports 434, as illustrated in FIG. 18.

When pouring machine 300 is in operation, concrete is dispensed from hoppers 342 through chutes 346. The concrete is then spread out in concrete form 42 of first concrete spreader means 310 as pouring machine 300 moves along concrete form 42. Concrete compaction means 312 compacts the concrete, and concrete form vibration means 314 vibrates concrete form 42 to vibrate and settle the concrete therein as pouring machine 300 moves along concrete form 42. In vibrating concrete form 42, longitudinal frame members 416 are moved to the concrete form vibrating position by actuators 424 acting through pivotal arms 418. Upon moving to the concrete form vibrating position, electromagnetic plates 430 attach themselves to a band 432 upon the actuation thereof. Consequently, vibrations of hydraulic vibrators 426, 428 are transferred through electromagnetic plates 430 and to band 432. Improved vibration and settling of the concrete in concrete form 42 is achieved when electromagnetic plates 430 are directly adjacent form supports 434, being separated therefrom only by band 432. Form supports 434 are connected to concrete form 42 and are substantially uniformly spaced along the sides thereof. Consequently, electromagnetic plates 430 and the corresponding hydraulic vibrators are offset from each other longitudinally, as indicated by arrows 435 and 436 in FIG. 16, such that as pouring machine 30 moves along concrete form 42, electromagnetic plates 430 slide along band 432, and at least one electromagnetic plate 430 is always adjacent a form support 434 for vibrating it through band 432. When pouring machine 300 reaches the other end of concrete form 42, electromagnetic plates 43 and vibrators 426, 428 are deactivated, and longitudinal frame members 416 are pivoted by actuators 424 to the withdrawn or retracted position.

Second concrete spreader means 316 includes a vibrating frame 437 which is tethered to the trailing end of frame structure 302 of pouring machine 300 by ropes, cables, or chains 438. Hydraulic vibrators 439 are connected to vibrating frame 437 for vibrating same such that vibrating frame 437 acts as an auxiliary screed to provide the upper surface of concrete members 172 in concrete form 42 with a smooth surface finish. Hydraulic vibrators 439 are connected to power unit 340 for the actuation thereof.

Figure 17:
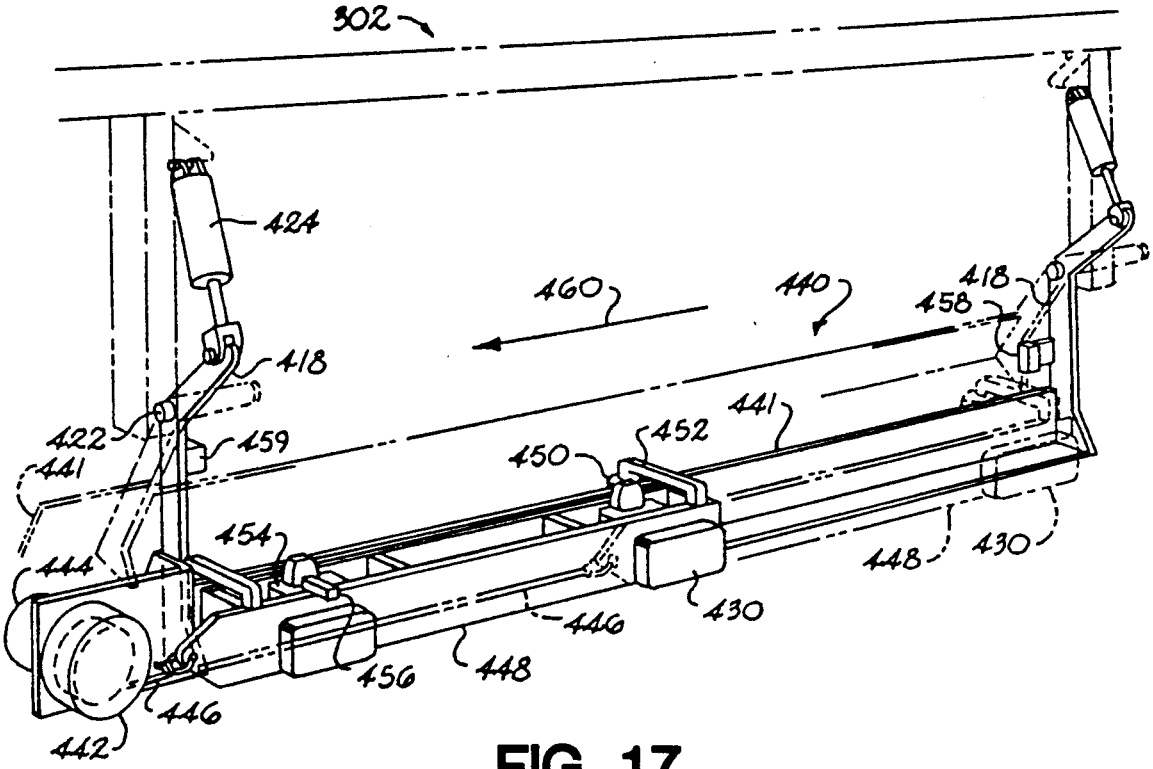
FIG. 17 is a partial perspective view of an alternate embodiment of a concrete form vibration system constructed in accordance with the present invention and attachable to the pouring machine.

An alternate embodiment of a concrete form vibration means is illustrated in FIG. 17 and is designated generally as 440. Concrete form vibration means 440 includes longitudinal frame members 416 which are pivoted by pivotal arms 418 under the force of actuators 424 in similar manner as is concrete form vibration means 314. Concrete form vibration means 440 for only one side of elongated concrete frame 42 is illustrated in FIG. 17 for purposes of clarity, but it is to be understood that such vibration means is likewise provided on the other side of pouring machine 300 for contacting the other side of concrete form 42.

Concrete form vibration means 440 includes a reel 442 which is powered by a hydraulic motor 444 connected to power unit 340. Extending from reel 442 is a cable 446 which is attached to a carriage or sled 448. Sled 448 is supported on longitudinal frame member 441 by rollers 450 attached to cross-members 452. Upon actuation of reel 442, cable 446 pulls sled 448 from the phantom position shown in FIG. 17 to the solid line position shown in FIG. 17. Attached to sled 448 are electromagnetic plates 430 which are connected to hydraulic vibrators 454.

Concrete form vibrator 440 includes a sled proximity switch 456 attached to sled 448, a rearward proximity switch 458 attached to the rearward pivotal arm 418, and a forward proximity switch 459 attached to the forward pivotal arm 418.

In the operation of concrete form vibrator 440, as pouring machine 300 is advanced along concrete form 42, forward proximity switch 459 senses the first form supports 434 positioned along side of concrete form 442 and delays activation of the electromagnetic plates 430 and hydraulic vibrators 454 until electromagnetic plates 430 are positioned about concrete form 42. As a sled proximity switch 456 senses a form support 434, electromagnetic plates 430 on that sled are at that time each positioned adjacent a form support 434, separated therefrom only by steel band 432. Electromagnetic plates 430 and vibrators 454 are then activated such that electromagnetic plates 430 move forward to engage band 432 so that the vibration of vibrators 454 is transmitted through electromagnetic plates 430, band 432, and through form supports 434. Since pouring machine 300 is continuously moving, sled 448 simply moves along longitudinal frame member 441 on rollers 450 as pouring machine 300 moves along concrete form 42. However, when rearward proximity switch 458, which is attached to pivotal arm 418, and which is consequently moving along the pouring machine 300, senses that it is approaching the rear end of sled 448, rearward proximity switch 458 signals electromagnetic plates 430 and vibrators 454 to deactivate and for reel 442 to activate to pull sled 448 forward by cable 446, as shown by arrow 460. Meanwhile, while this sled 448 is being moved forward, a corresponding sled 448 on the other side of pouring machine 300 attaches itself to the steel band on the other side of concrete form 42 adjacent to other form supports 434.

Once forward proximity switch 456 senses another form support 434, electromagnetic plates 430 and vibrators 454 again become activated to become attached to band 432. Meanwhile, the other sled on the opposite side of pouring machine 300 is being advanced by another reel along another longitudinal frame member. Thus, at least two form supports 434 are being vibrated at any given time, because while one sled 448 is being advanced by a cable 46, the other sled is held stationary to band 432 by magnetic plates 430 for vibrating two form supports 434. Proximity switches 456, 458, 459, reel 442, hydraulic vibrators 454, and magnetic plates 430 may all be connected to control station 358 which may include control means for coordinating the operation thereof.

Still another aspect of the present invention includes a method for pouring concrete into elongated form 42. The method comprises supplying concrete to elongated concrete form 42 with concrete supply means 308 as frame structure 302 of pouring machine 300 moves along concrete form 42.

The method includes spreading out the concrete supplied to concrete form 42 by concrete supply means 308 with first concrete spreader means 310, while moving frame structure 302 along concrete form 42. The spreading of the concrete is accomplished by vibrating frame 378 which includes plate 379 for contacting and vibrating the concrete to spread it out in elongated form 42.

After spreading of the concrete by first concrete spreader means 310, the compacting of the concrete into concrete form 42 is accomplished by concrete compaction means 312. Concrete compaction means includes a vibrating frame 410 which is vibrated by vibrators 412 such that bottom plate member 414 packs the concrete down into deck portion 124 and stem portions 144 of concrete form 42. Meanwhile, the vibrating of concrete form 42 is accomplished by concrete form vibration means 314 or 440. Concrete form vibration means 314 includes electromagnetic plates 430 which attach to bands 432 and which are vibrated by hydraulic vibrators 426, 428 as pouring machine 300 moves along concrete form 42. Finally, the concrete is again spread by second concrete spreader means 316 which includes vibrating frame 437 tethered to frame structure 302 of pouring machine 300 by chains 438. Vibrating frame 437 includes pneumatic oscillator 439 attached thereto which serve to provide the upper surface of concrete members 172 with a smooth finish.

Pouring machine 300 allows for the use of concrete having a lower slump value than the slump value of concrete conventionally used to form such concrete members as described. Slump value refers to a common measurement of the consistency of concrete. With the use of lower slump concrete, less cement and water are required to make the concrete. Therefore, a substantial cost savings can be realized by using pouring machine 300 because of the capability of concrete machine 300 to use lower slump concrete to form concrete members.

It is understood that various motors, actuators, couplings, fittings, connections, controls, etc., which are within the purview of one of ordinary skill in the art, can be used in the construction of utility machine 10 and pouring machine 300 without departing from the scope of the present invention.

From the foregoing, it can be seen that the present invention provides a utility machine for setting up a concrete form for the pouring of concrete therein, a method for setting up the concrete form, a pouring machine for pouring concrete into the concrete form, and a method for pouring concrete into the concrete form. Accordingly, the present invention meets the objectives set forth above.

While one preferred embodiment of the invention has been described using specific terms, such description is for the present illustrative purposes only and it is to be understood that changes and variations to such embodiment, including but not limited to the substitution of equivalent features or parts, and the reversal of various features thereof, may be practiced by those of ordinary skill in the art without departing from the spirit and scope of the following claims.

What is claimed:

1. An apparatus for pouring concrete into a concrete form, comprising:

a frame structure positionable above the concrete form;

support means provided on said frame structure for supporting said frame structure above the concrete form for movement therealong;

concrete supply means provided on said frame structure for supplying concrete to the concrete form; and concrete form vibration means provided on said frame structure and contactable with the concrete form for vibrating the concrete form and settling the concrete supplied thereto as said frame structure moves along the concrete form; wherein said concrete form vibration means comprises at least one vibrator support connected to said frame structure and movable between a concrete form vibrating position and a retracted position;

vibrator means connected to said vibrator support for contacting and vibrating the concrete form when said vibrator support is in said concrete form vibrating position, said vibrator means remaining in contact with the concrete form for vibrating the concrete form as said frame structure moves along the concrete form;

at least one energizable electromagnet for contacting the concrete form upon energization thereof and upon said vibrator support being in said concrete form vibrating position; and a fluid actuated vibrator connected to said electromagnet for vibrating the concrete form upon contact of said electromagnet with the concrete form.

2. An apparatus as set forth in claim 1, further comprising:

an actuator connected between said vibrator support and said frame structure for moving upon actuation thereof said vibrator support between said concrete form vibrating position and said retracted position.

3. An apparatus as set forth in claim 2, further comprising:

pivotal connection means provided between said vibrator support and said frame structure for allowing said vibrator support to pivot between said concrete form vibrating position and said retracted position.

4. An apparatus as set forth in claim 1, further comprising:

first concrete spreader means provided on said frame structure for spreading out in the concrete form the concrete supplied thereto.

5. An apparatus as set forth in claim 4, further comprising:

second concrete spreader means connected to said frame structure for spreading out in the concrete form the concrete supplied thereto after the concrete has been spread out by said first concrete spreader means.

6. An apparatus for pouring concrete into an elongated concrete form, comprising:

a frame structure positionable above the elongated concrete form;

support means provided on said frame structure for supporting said frame structure above the elongated concrete form for movement therealong;

motive means provided on said frame structure for moving said frame structure along the elongated concrete form on said support means;

concrete supply means provided on said frame structure for supplying concrete to the elongated concrete form;

first concrete spreader means provided on said frame structure for spreading out in the elongated concrete form the concrete supplied thereto;

concrete compaction means provided on said frame structure for compacting into the elongated concrete form the concrete supplied thereto;

concrete form vibration means provided on said frame structure and contactable with the elongated concrete form for vibrating the elongated concrete form and settling the concrete supplied thereto as said frame structure moves along the elongated concrete form;

second concrete spreader means connected to said frame structure for spreading out in the elongated concrete form the concrete supplied thereto after the concrete has been spread out by said first concrete spreader means; wherein said concrete form vibration means comprises at least one vibrator support connected to said frame structure and movable between a concrete form vibrating position and a retracted position;

vibrator means connected to said vibrator support for contacting and vibrating the concrete form when said vibrator support is in said concrete form vibrating position, said vibrator means remaining in contact with the concrete form for vibrating the concrete form as said frame structure moves along the concrete form;

at least one energizable electromagnet for contacting the concrete form upon energization thereof and upon said vibrator support being in said concrete form vibrating position; and a fluid actuated vibrator connected to said electromagnet for vibrating the concrete form upon contact with the concrete form by said electromagnet.

7. An apparatus as set forth in claim 6, wherein said support means comprises:

downwardly extending portions connections to said frame structure for straddling the elongated concrete form; and a plurality of wheels rotatably mounted to said downwardly extending portions for supporting said frame structure for movement relative to the elongated concrete form.

8. An apparatus as set forth in claim 7, wherein said motive means provided on said frame structure comprises:

a motor connected to at least one of aid plurality of wheels for rotating at least one of said plurality of wheels to move said frame structure along the elongated concrete form.

9. An apparatus as set forth in claim 8, wherein said motor is hydraulically powered and wherein a source of pressurized by hydraulic fluid is provided on said frame structure in fluid communication with said motor for powering said motor.

10. An apparatus as set forth in claim 6, wherein said concrete supply means inlcudes a concrete hopper having a vibratory outlet for supplying concrete therefrom into the elongated concrete form.

11. An apparatus as set forth in claim 6, wherein said first concrete spreader means comprises:

a first spreader frame connected to said frame structure and movable between a raised position and a lowered, concrete spreading position;

actuation means connected between said first spreader frame and said frame structure for moving upon actuation thereof said first spreader frame between said raised and lowered positions;

a spreading member connected to said first spreader frame for contacting and spreading concrete in the concrete form when said first spreader frame is in said lowered position; and vibrator means connected to said spreading member for vibrating said spreading member to facilitate the spreading of the concrete by said spreading member.

12. An apparatus as defined in claim 11, wherein said spreading member includes at least one projecting portion positionable over a stem portion of the concrete form for spreading concrete into the stem portion as said frame structure moves along the concrete 13. An apparatus as set forth in claim 11, wherein said vibrator means connected to said spreading member includes at least one hydraulically powered motor and wherein a sensor is associated with said first spreader frame and said frame structure for sensing the relative positions thereof with respect to one another.

14. An apparatus as set forth in claim 6, wherein said concrete compaction means comprises:

a compaction frame connected to said frame structure and movable between a raised position and a lowered, concrete compacting position;

actuation means connected between said compaction frame and said frame structure for moving upon actuation thereof said compaction frame between said raised and lowered positions;

a compacting member connected to said compaction frame for contacting and compacting concrete in the concrete form when said compaction frame is in said lowered position; and vibrator means connected to said compacting member for vibrating said compacting member to facilitate the compacting of the concrete by said compacting member.

15. An apparatus as set forth in claim 14, wherein said vibrator means connected to said compacting member includes at least one hydraulically powered motor and wherein a sensor is associated with said compaction frame and said frame structure for sensing the relative positions thereof with respect to one another.

16. An apparatus as set forth in claim 6, wherein said second concrete spreader means includes a spreader frame connected to said frame structure and vibrator means connected to said spreader frame for vibrating said spreader frame to facilitate the spreading of concrete in the concrete form.

17. An apparatus as set forth in claim 6, further comprising:

an actuator connected between said vibrator support and said frame structure for moving upon actuation thereof said vibrator support between said concrete form vibrating position and said retracted position.

18. An apparatus for pouring concrete into a concrete form, comprising:

a frame structure positionable above the concrete form;

support means provided on said frame structure for supporting said frame structure above the concrete form for movement therealong;

concrete supply means provided on said frame structure for supplying concrete to the concrete form; and concrete form vibration means provided on said frame structure and contactable with the concrete form for vibrating the concrete form and settling the concrete supplied thereto as said frame structure moves along the concrete form; wherein said concrete form vibration means comprises at least one vibrator support connected to said frame structure and movable between a concrete form vibrating position and a retracted position; and vibrator means connected to said vibrator support for contacting and vibrating the concrete form when said vibrator support is in said concrete form vibrating position, said vibrator means remaining in contact with the concrete form for vibrating the concrete form as said frame structure moves along the concrete form;

said apparatus further comprising transport means connected to said vibrator means for intermittently moving said vibrator means along said support therefor from adjacent one predetermined location to another as the frame structure moves substantially continuously along the concrete form.

19. An apparatus for pouring concrete into a concrete form, comprising:

a frame structure positionable above the concrete form;

support means provided on said frame structure for supporting said frame structure above the concrete form for movement therealong;

concrete supply means provided on said frame structure for supplying concrete to the concrete form; and concrete form vibration means provided on said frame structure and contactable with the concrete form for vibrating the concrete form and settling the concrete supplied thereto as said frame structure moves along the concrete form; wherein said concrete form vibration means comprises at least one vibrator support connected to said frame structure and movable between a concrete form vibrating position and a retracted position;

vibrator means connected to said vibrator support for contacting an vibrating the concrete form when said vibrator support is in said concrete form vibrating position, said vibrator means remaining contact with the concrete form for vibrating the concrete form as said frame structure moves along the concrete form; and a carriage mounted on said vibrator support for movement relative thereto, and connected to at least one energizable electromagnet.

20. An apparatus as set forth in claim 19, further comprising:

a powered reel attached to said vibrator support having a cable provided thereon, said cable having one end attached to said carriage, such that when said reel is activated, said cable wound thereon and said cable pulls said carriage to advance said carriage along said vibrator support; and sensor means associated with said vibrator support and said carriage and connected to said reel for sensing when said carriage is to be advanced and for signaling said reel to advance said carriage.

* * * * *

UNITED STATES PATENT AND TRADEMARK OFFICE

CERTIFICATE OF CORRECTION

PATENT NO. : 5,035,592

DATED : July 30, 1991

INVENTOR(S) : Lowndes, III et al.

It is certified that error appears in the above-identified patent and that said Letters Patent is hereby corrected as shown below:

Column 24, claim 18, line 58, change "an" to --and--; and
line 60, insert --in-- after "remaining".

Signed and Sealed this

Thirteenth Day of October, 1992

*Attest:*

*Attesting Officer*

DOUGLAS B. COMER

*Acting Commissioner of Patents and Trademarks*